US005523737A

United States Patent [19]

Luna

[11] Patent Number: 5,523,737

[45] **Date of Patent: *Jun. 4, 1996**

[54] UNIVERSAL INTELLIGENT GROUP GUIDANCE SYSTEM AND METHOD

[76] Inventor: Luis A. Luna, Calle 7, Quinta Haydee, Colinas de Vista Alegre, Caracas 1020, Venezuela

[ * ] Notice: The term of this patent shall not extend beyond the expiration date of Pat. No. 5,324,028.

[21] Appl. No.: 238,286

[22] Filed: May 4, 1994

Related U.S. Application Data

[63] Continuation-in-part of Ser. No. 965,321, Oct. 23, 1992, Pat. No. 5,324,028.

[51] Int. Cl.[6] ..... G08B 23/00

[52] U.S. Cl. ..... 340/323 R; 235/376; 364/410; 473/131

[58] Field of Search ..... 340/286.01, 323 R; 235/376, 385, 375; 364/410; 273/32 R, 176 L

[56] References Cited

U.S. PATENT DOCUMENTS 1,737,520 2/1928 Richardson, Jr. .
3,760,360 9/1973 Reynolds et al. .
4,163,123 7/1979 Brodsky et al. ..... 340/286.01
4,437,085 3/1984 Salant .
5,086,390 2/1992 Matthews ..... 340/323 R
5,097,416 3/1992 Matthews ..... 340/323 R
5,120,942 6/1992 Holland et al. .
5,305,201 4/1994 Matthews ..... 340/323 R
5,324,028 6/1994 Luna ..... 340/323 R

*Primary Examiner*—Brent A. Swarthout
*Attorney, Agent, or Firm*—Keck, Mahin & Cate

[57] ABSTRACT

A system and method for guiding a party of people around a facility having a plurality of consecutively designated events to be visited by the party, each event having a front area port and an exit area port associated therewith, includes a system control center for transmitting information to and receiving information from the front area ports and exit area ports, a system for designating an event to be visited by the party and for subsequently designating a next event to be visited by the party, the next event bearing a designation other than the next consecutive designation compared with the designation of the event visited. The front area ports and the exit area ports are able to transmit information to and receive information from the system control center. The order in which the events are visited is determined by the system control center in response to information identifying the party and at least one of the events may be visited out of the consecutively designated order of the events.

28 Claims, 18 Drawing Sheets

| ENTRANCE AREAS OF EVENTS | EXIT AREAS OF EVENTS | | | | | | | | | | | | | | | | | MAIN COUNTER AND SERVICE AREAS | | | |
|---|---|---|---|---|---|---|---|---|---|---|---|---|---|---|---|---|---|---|---|---|---|
| | 01 | 02 | 03 | 04 | 05 | 06 | 07 | 08 | 09 | 10 | 11 | 12 | 13 | 14 | 15 | 16 | 17 | 18 | MC | SA1 | SA2 | SA3 | SA4 |
| 01 | | | | | | | | | | | | | | | | | | | | | | | |
| 02 | | | | | | | | | | | | | | | | | | | | | | | |
| 03 | | | | A | | | | | | | | | | | | | | | | | | | |
| 04 | | | | | | | | | | | | | | | | | | | | | | | |
| 05 | | | | F | | | | | | | | | | | | | | | | | | | |
| 06 | | | | | | | | | | | | | | | | | | | B | | | | |
| 07 | | | | | | | | | | | | | | | | | | | | | | | |
| 08 | | | | | | | | | | | | | | | | | | | | | | | |
| 09 | | | | | | | | | | | | | | | | | C | | | | | | |
| 10 | | | | | | | | | | | | | | | | | | | | | | | |
| 11 | | | | | | | | | | | | | | | | | | | | | | | |
| 12 | J | | | | | | | | | | | | | | | | | | | | | | |
| 13 | | | | | | | | | | | | | | | | | | | | | | | |
| 14 | | | | | | | | | | | | | | | | | | | | | | | |
| 15 | | | | | | | | | | | | | | | | | | | | | | | |
| 16 | | | | | | | | | | | | | | | | | | | | | | | |
| 17 | | | | | | | | | | | | | | | | | | | | | | | |
| 18 | | | | | | | | | | | | | | | | | | | | | | | |

| DELAY FACTOR OF EVENTS | 01 | 02 | 03 | 04 | 05 | 06 | 07 | 08 | 09 | 10 | 11 | 12 | 13 | 14 | 15 | 16 | 17 | 18 |
|---|---|---|---|---|---|---|---|---|---|---|---|---|---|---|---|---|---|---|
| | | | A | | | | | | | | | | E | | | J | | |

FIG. 3

UNIVERSAL INTELLIGENT GROUP GUIDANCE SYSTEM AND METHOD

RELATED APPLICATION

This application is a continuation-in-part of U.S. patent application Ser. No. 07/965,321, filed Oct. 23, 1992, now U.S. Pat. No. 5,324,028.

FIELD OF THE INVENTION

A universal and multidisciplinary system and method for optimal usage of a facility having multiple events for attention and/or participation of discrete groups of persons is described. Such facilities include, among others, facilities that offer recreation, exhibitions, excursions, demonstrations, tourism, and education. The system allows congestion at a facility to be minimized by monitoring progress of each group and selecting the order in which events provided by the facility are visited by each group.

The group guidance system and method described is based on an exchange of information and commands between the individual groups and the system, by which the system indicates to each group the event to be attended following completion of attendance at the previous event. Each group reports to the system at the commencement and termination of participation in each event and the next designated event to be visited may not be an event designated consecutively following the event just visited, depending on the usage and congestion at various events of the facility.

BACKGROUND OF THE INVENTION

The invention is a system for guiding parties around an amusement park, large museum, tourist facility or other location in an efficient manner to avoid congestion and long waiting periods. Known patents do not address the issue of avoiding congestion in such a facility.

Richardson, Jr., U.S. Pat. No. 1,737,520, describes a directory board for tracing a route between two predetermined points. Avoidance of congestion is not addressed in the patent.

Reynolds et al., U.S. Pat. No. 3,760,360, describes a locator system for displaying the position of a party on a map. This patent also does not consider congestion.

Salant, U.S. Pat. No. 4,437,085, is directed to determining the most time efficient route for deliveries. The route is mapped on a screen.

Holland et al., U.S. Pat. No. 5,120,942, is directed to a computer program for making sure that all stations of a facility are visited. The tour to be made is organized into zones, each including a set of checkpoints. Each checkpoint is labelled by a barcode. Individual checkpoints may be designated with higher or lower priority checkpoints. The tour may be monitored but avoidance of congestion is not considered as a parameter in the computer program. None of these known patents discloses a method which relies on a computer program to determine the selection of the route taken by a party during a tour of the facility.

SUMMARY OF THE INVENTION

The Universal Intelligent Group Guidance (UIGG) System is a universal and multidisciplinary system, the purpose of which is to achieve the optimum administration of space, time, and the other resources of those multiple facilities where a given management or organization offers different repetitive and/or periodic events, to persons or to discrete groups of persons, within a physical or virtual scenario common to the events.

The facilities are those made up of multiple different events directed to the attention and/or participation of discrete groups of persons. These include, among others, facilities that offer recreation, exhibitions, excursions, demonstrations, tourism, and education.

The system is universal, given the fact that it is universally applicable to those activities that comprise the group, event, and scenario, under a common management or organization, as described and/or defined in this document. UIGG is a system that, while being simple in concept, is adaptable to any installation or facility, however large and complex it may be. The UIGG system can be used in facilities that are small or large, formal or informal, and of short or long duration.

The characteristic that makes the UIGG system unique is the group guidance technique that is used. The group guidance system is based on an exchange of information and commands between each group and the system, through which the system indicates to each group which event they should be attending each time the system is queried for that information. Each group reports to the system at the commencement and termination of participation in each event.

The technique is dynamic, both in the execution of its routines and in the updating of its knowledge regarding the progress of each group and the situation of the events of the scenario.

The technique is put into practice through the use of computer software designed for each particular application; it is provided with all data related to the scenario, the events, and the groups participating in the activity. This software analyzes, processes, and stores all details of the progress of the groups within the scenario, in a manner such that the system can distribute and guide the groups in the scenario, under logical criteria involving management efficiency and comfort for the users, while avoiding or minimizing congestion at the facility.

The system communicates with the groups by means of communication ports located at the entrances and exits to each event and the service areas of the facilities. The system uses these ports to inform each group which event is to be participated in at any given time; likewise, the groups can use these ports to generate reports related to their passage through the scenario, such as those described below.

The system takes control, automatically and impersonally, of the activities of the scenarios, by means of the above-described technique. The UIGG system assumes the management of the scenario and the events. The system can also form the groups, where this is necessary, and the system indicates to each group the first event that the group is to participate in, and, at the end of this event and at the end of each succeeding event, tells the group the next event to be participated in. In other words, the UIGG system guides the groups throughout their passage through the events of the scenario. Likewise, the system schedules and/or modifies the presentation times of cyclic events as a function of the number of patrons present in the scenario at a given time.

The work is performed by the UIGG system based upon the scenario, group, and event data that has been provided to the system, and through the system's monitoring of the groups during their passage through the scenario. The UIGG system knows at all times where each group is, which events it has competed and which ones it still has pending. Likewise, the UIGG system records the use of the services offered by the groups.

In some multiple facilities, as in educational institutions (e.g., universities), the system can order and/or reorder the groups at the end of the events, which in this case are courses of academic subjects, depending upon the performance of each of their members. For example, if some of the students do not pass certain courses which are prerequisites for other courses of a higher level, the system reviews the situation and reconfigures the groups so that those that attend the courses meet the requirements of the course.

BRIEF DESCRIPTION OF THE DRAWINGS

FIG. 3 is a schematic view of a typical format specifying each event of a multiple event facility.

FIG. 4(*b*) is a plan view of the front and back of another personal identification device.

FIG. 4(*c*) is a plan view of a further personal identification device.

DETAILED DESCRIPTION OF THE PREFERRED EMBODIMENTS

Figure 1:
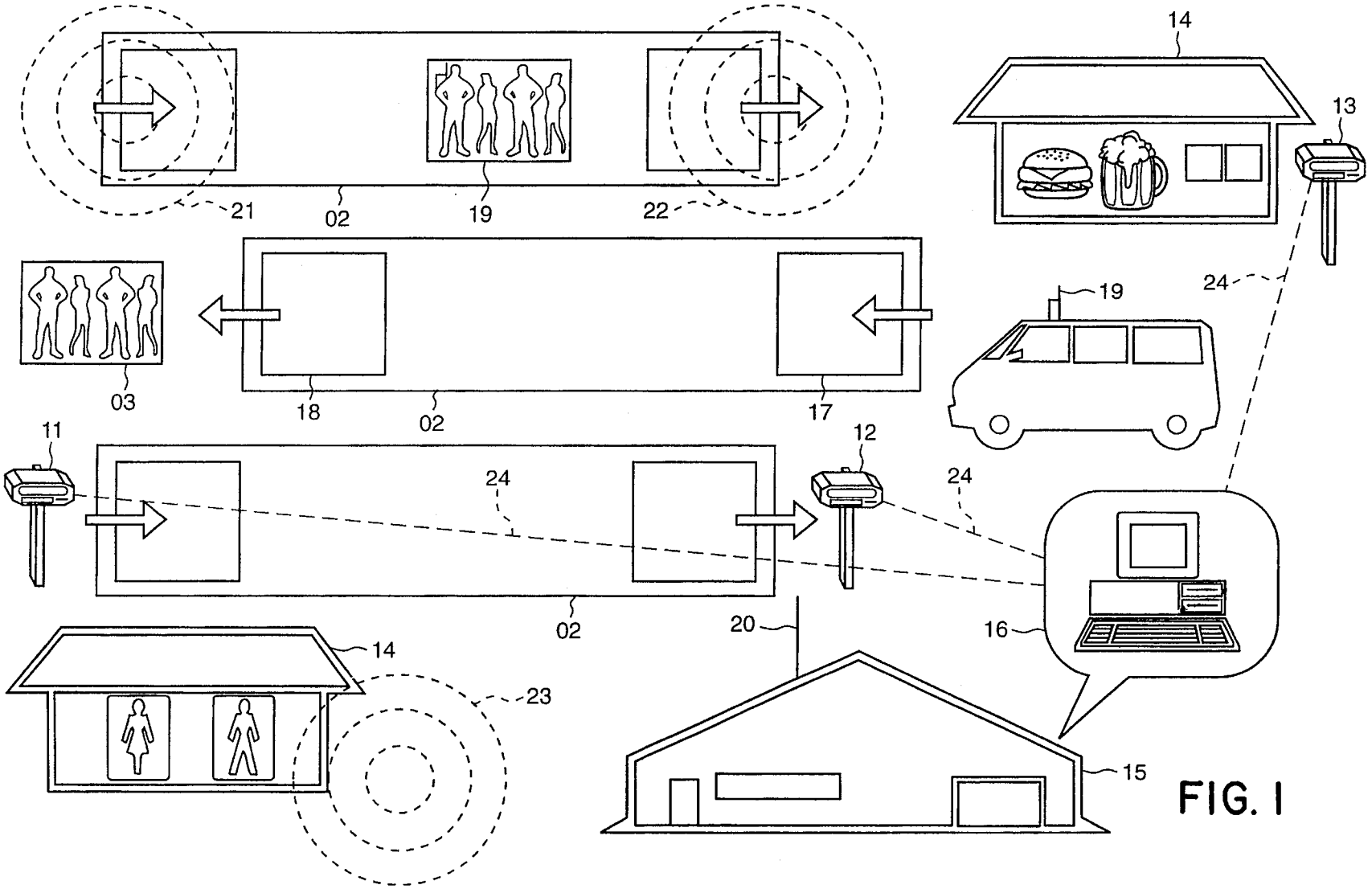
FIG. 1 is a schematic view of part of a multiple event facility showing components of a system of the invention.

FIG. 1 illustrates a multiple facility in which most of the components comprising the Universal Intelligent Group Guidance System are shown: front area port (FAP) (11), exit area port (EAP) (12) , service area port (SAP) (13) , service area (14) , ticket office or registration room (15), system control center (SCC) (16), event entrance Area (17), event exit area (18), group with transceiver (19), SCC central transceiver antenna (20), electro-magnetic field around the event entrance (21), electromagnetic field around event exit (22), electromagnetic field around service area (23), and communication means (COM) (24).

Figure 2:
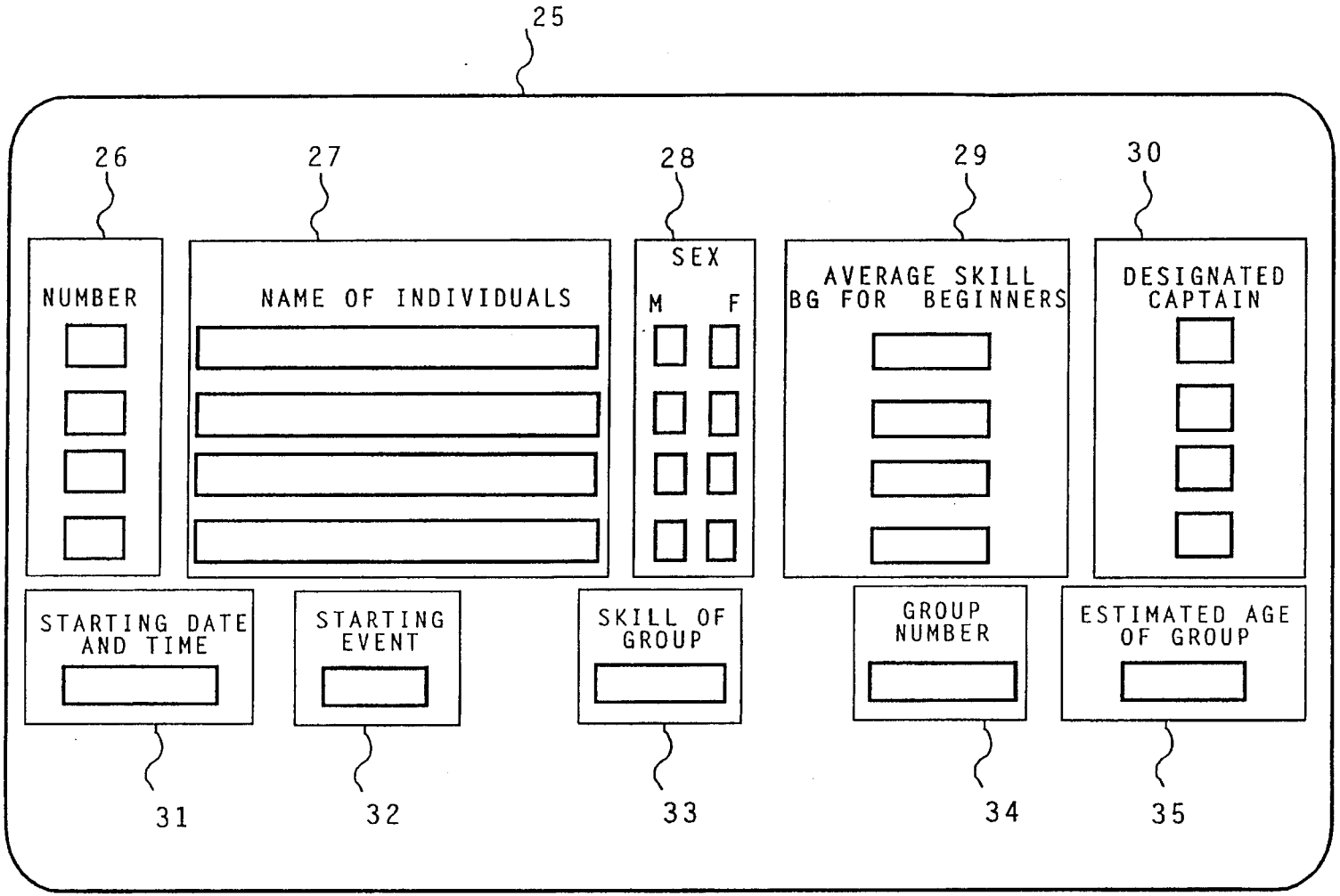
FIG. 2 is a schematic view of an example of an input screen for entering data concerning a group.

FIG. 2 shows the computer screen of the attendant after the data for a group has been entered. Here, some of the data generated by the UIGG system can also be seen: group data record, as it would be seen on the computer screen of the attendant (25), group component numbers (26), names of members (27), sex of members (28), each member's mastery of the subject (29), designated person in charge of group (30), date and time group begins its tour (31), starting event for the group (32), average mastery of the subject by the group (33), group identification number (34), and estimated average age of the group (35). This is a non-limiting example of the type of information which might be entered as data for a group.

FIG. 3 shows a form that specifies the most important characteristics of a multiple installation, as well as the accessibility of the entrances of each event from the exits of others and from the different service areas.

Figure 4A:
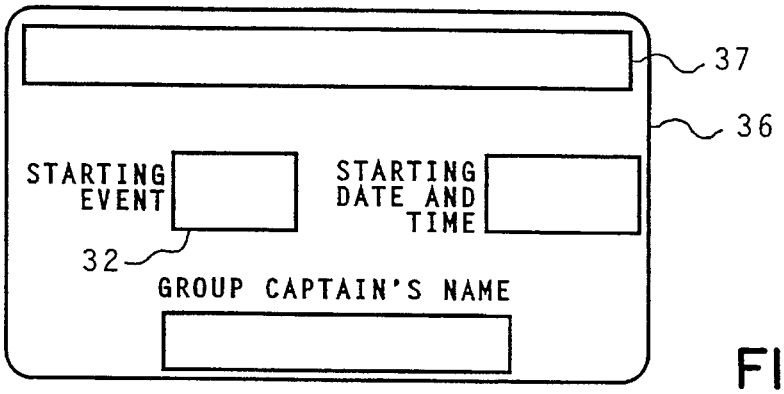
FIG. 4(*a*) is a plan view of a personal identification device.
Figure 4B:
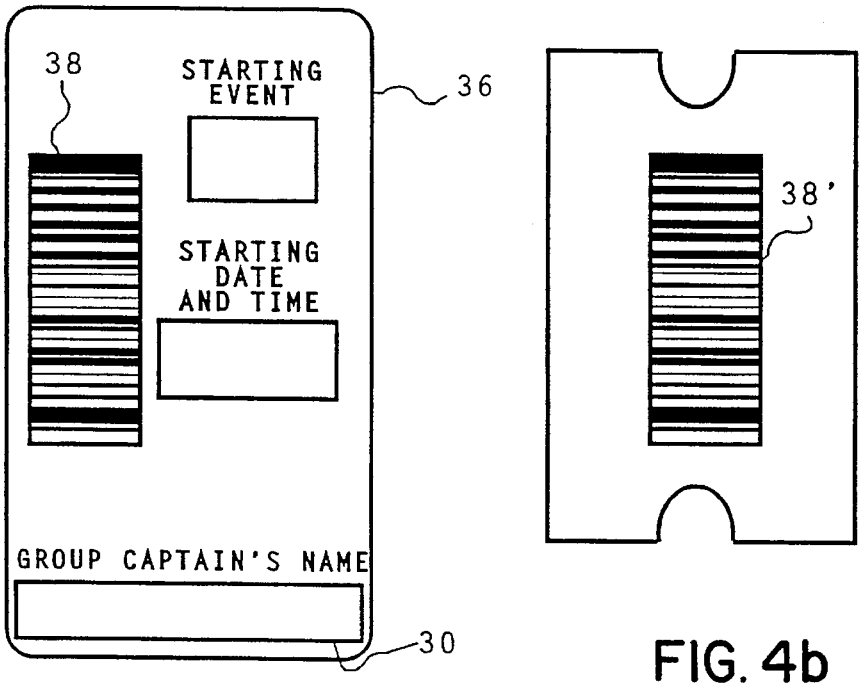
Figure 4C:
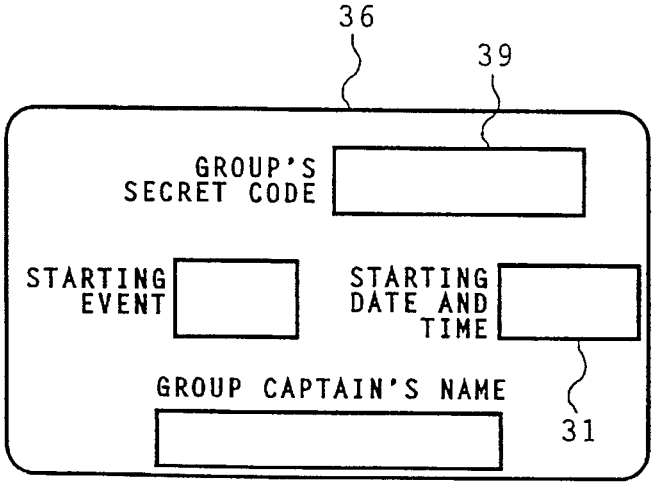

FIGS. 4(*a*), 4(*b*) and (4)(*c*) shows three possible alternative versions of a group identification means. A group identification device (GID) (36) can have a magnetic strip (37), an optical bar code (38) or of the ticket type (38') for recognition by optical reading means (XX), and that of the type using a "group code" (39). This figure also shows some data printed on the card: name of responsible person (30), starting date and time (31), and initial event (32).

Figure 5:
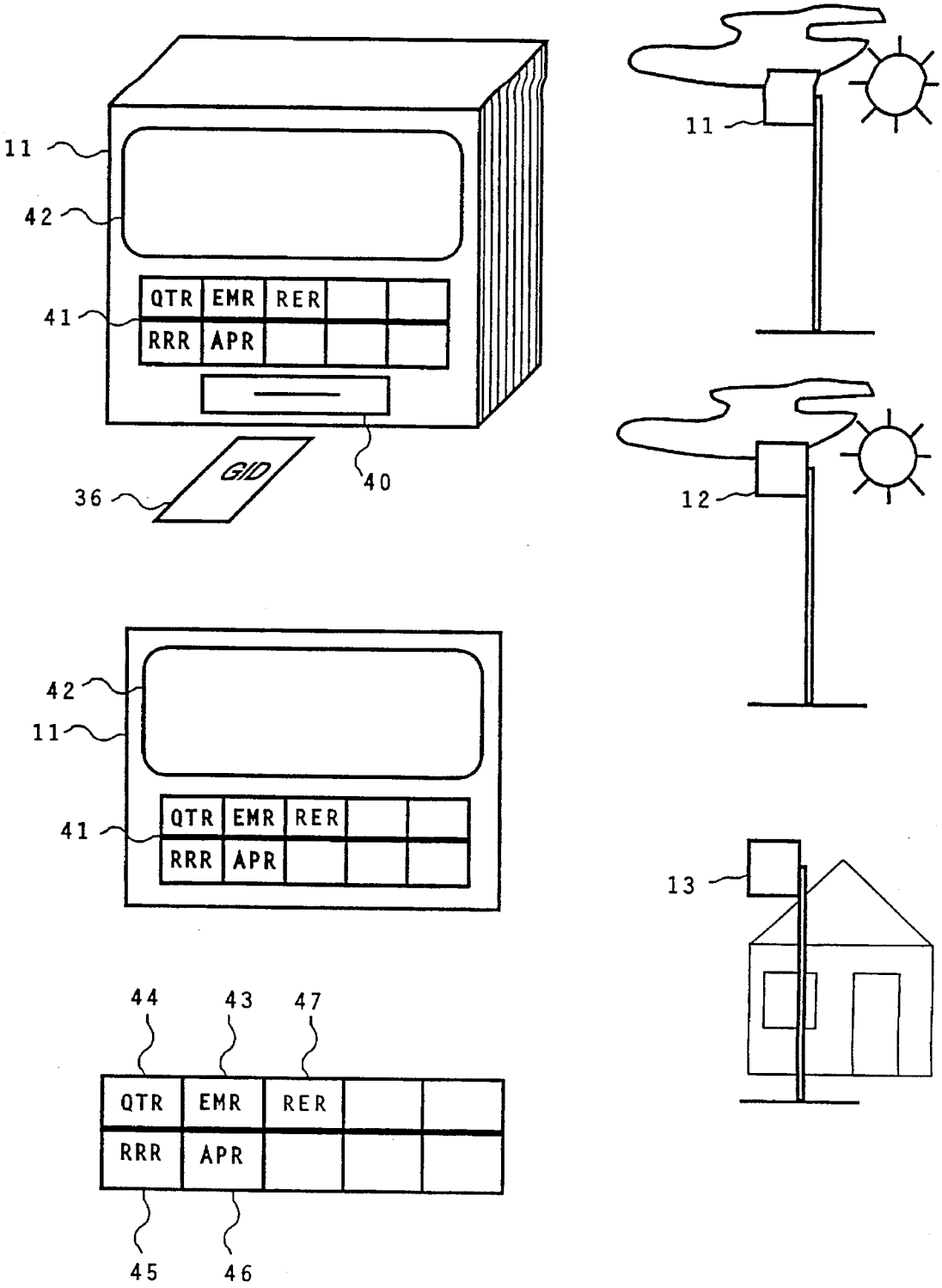
FIG. 5 is a schematic view of components of a front area port (FAP), exit area port (EAP), service area port (SAP) and related monitors.

FIG. 5 illustrates a basic version of ports FAP, EAP, and SAP, which are practically identical, being differentiated only by the manner in which the ports are coded for recognition by the system. The same figure shows some of the reports used by the groups: an FAP (11), an EAP (12), an SAP (13), the port screen (42), the GID reader (44), the keyboard for reports (41), quit report (QTR) (47), emergency report (EMR) (43), resume report (RRR). (45), authority presence request report (APR) (46), and repeat event report (RER).

Figure 6:
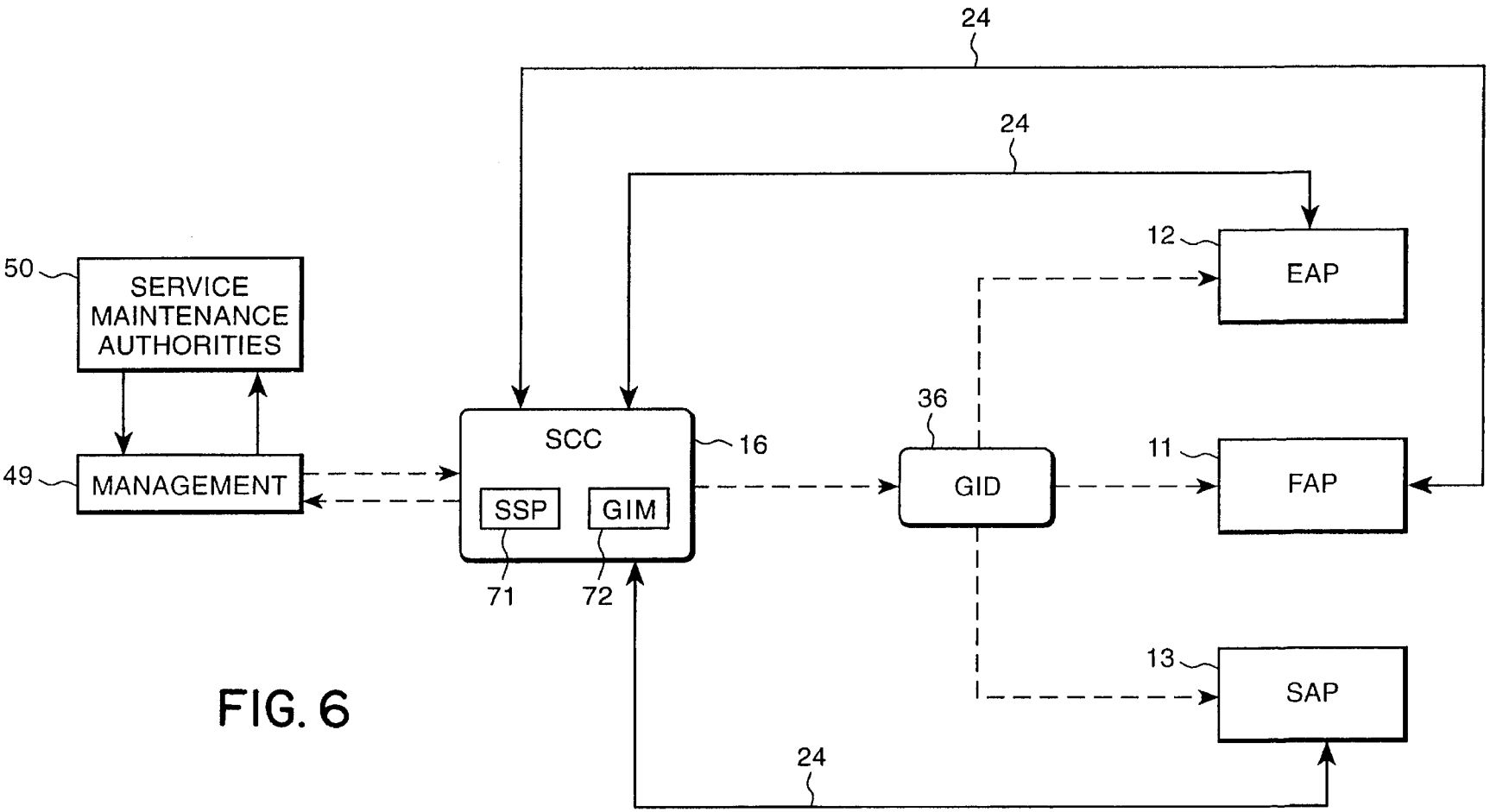
FIG. 6 is a schematic diagram showing connections between the main components of the system.

FIG. 6 indicates all of the principal system components: the system control center (SCC) (16), which contains the system software program (SSP) (47); and the group identification device maker (GIM) (48); along with the way in which the ports (11), (12) and (13) are connected with the SCC by the communications means (24), as well as their interrelationship with management (49) and the installation service and maintenance departments and authorities (50). GID (36) is shown as the access key for the groups to the ports.

Figure 7:
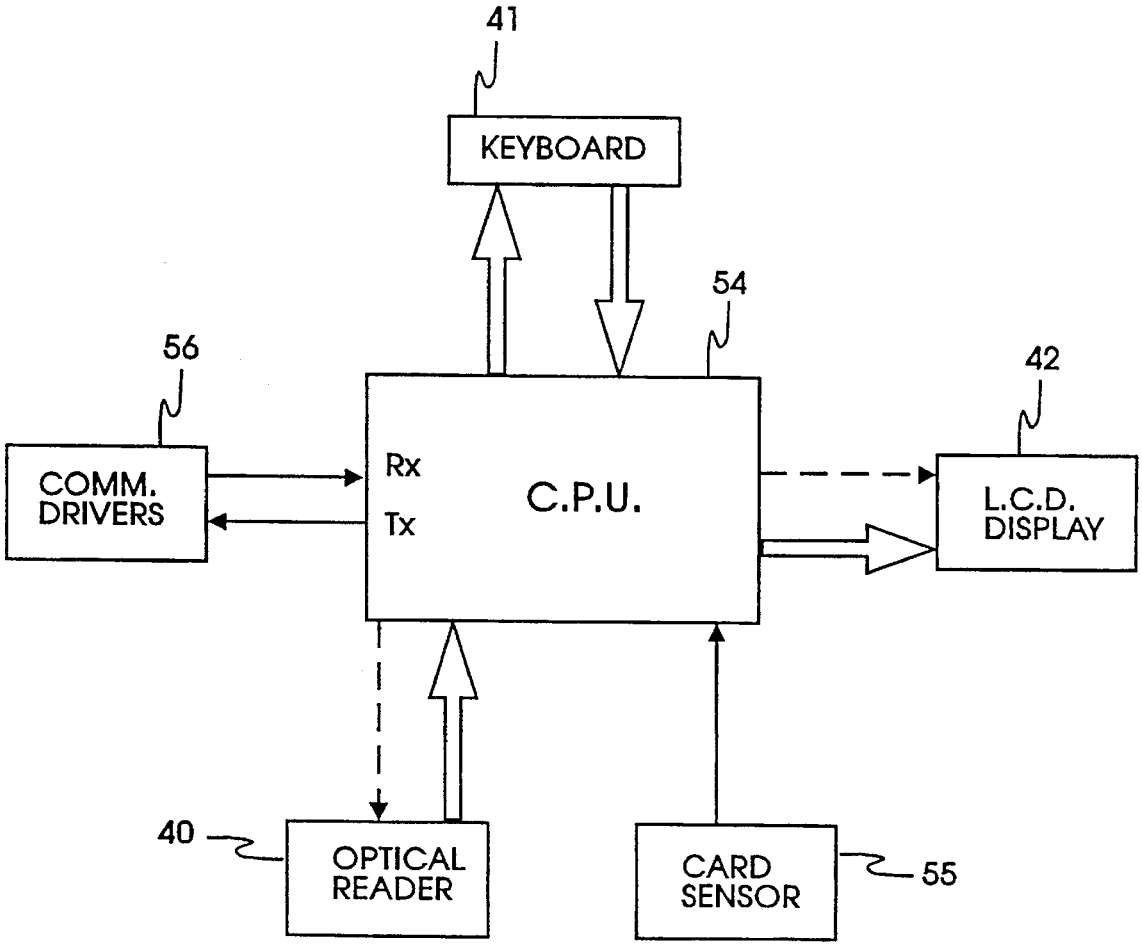
FIG. 7 is another schematic diagram showing connections between the main components of the system.

FIG. 7 shows the structural block diagram of the FAP, EAP, and SAP. In this figure the keyboard (41), LCD screen (42), optical reader (40), GID insert sensor (55), communication drivers (56), and central processing unit (CPU) (54) of the ports can be seen.

Figure 8:
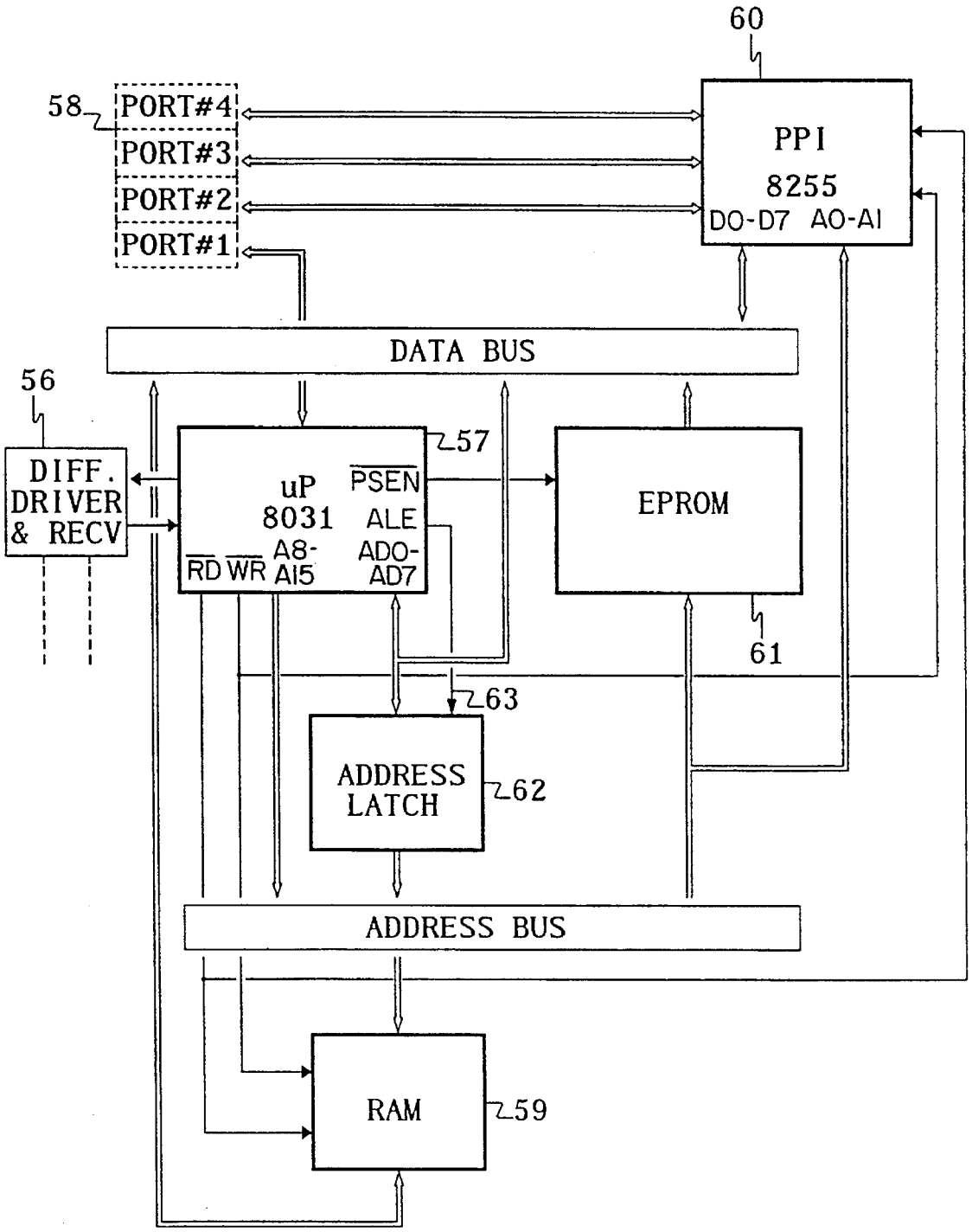
FIG. 8 is a block diagram showing the architecture of a typical front area port (FAP) TAP.

FIG. 8 shows the architectural block diagram of the FAP, EAP and SAP. Seen in the figure are: EPROM memory (61), external RAM memory (59), the programmable peripheral port interface (PPI) (60), the address latch (62), and the ALE signal (63).

Figure 9:
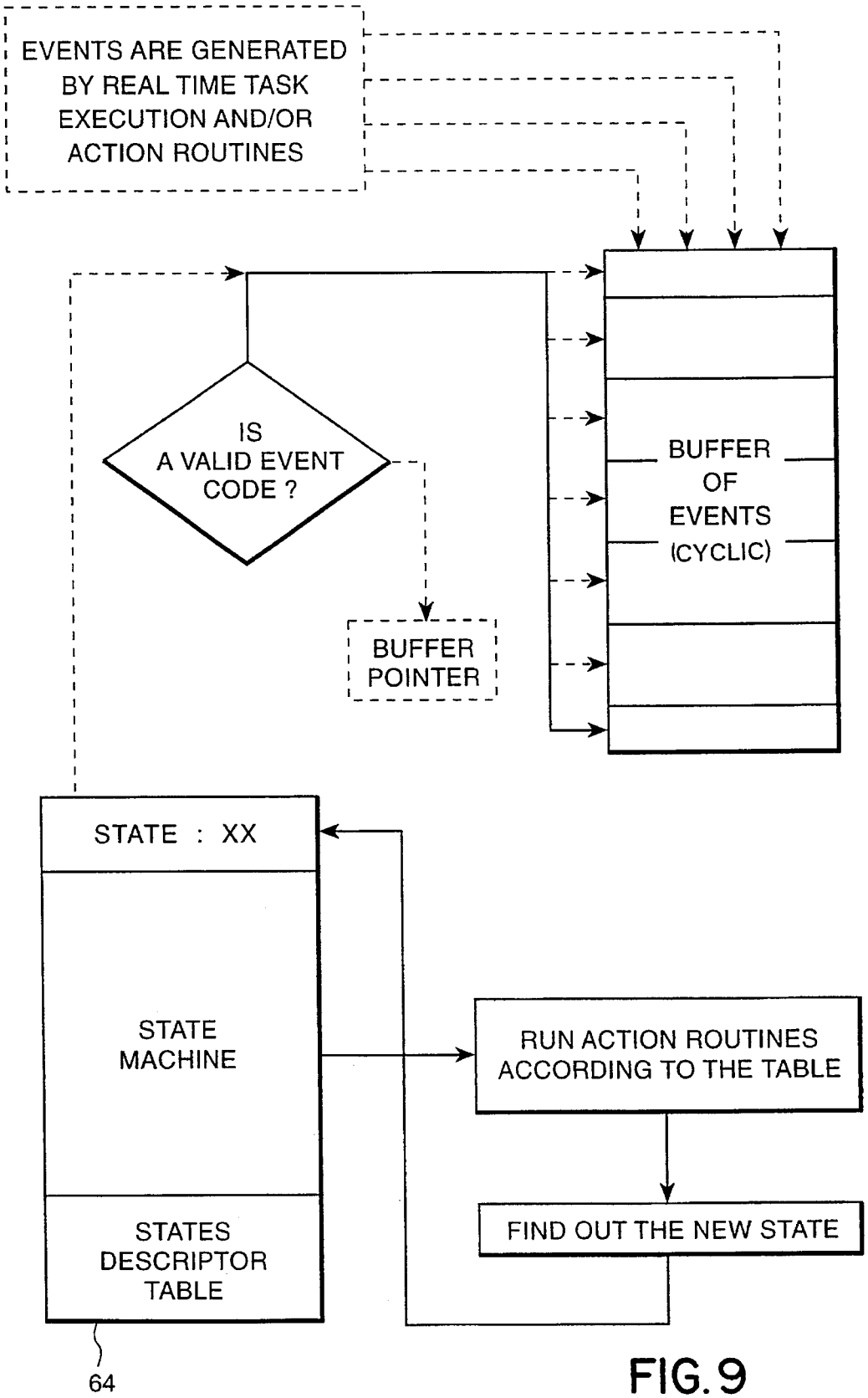
FIG. 9 is a flow diagram of the state machine functional scheme used for executing the software commands of the front area port, exit area port and service area port.

FIG. 9 shows the state machine functional scheme used for execution of the FAP, EAP, and SAP software routines, as a function of the information provided by the states table (64) in accordance with the occurrence of determined events.

Figure 10:
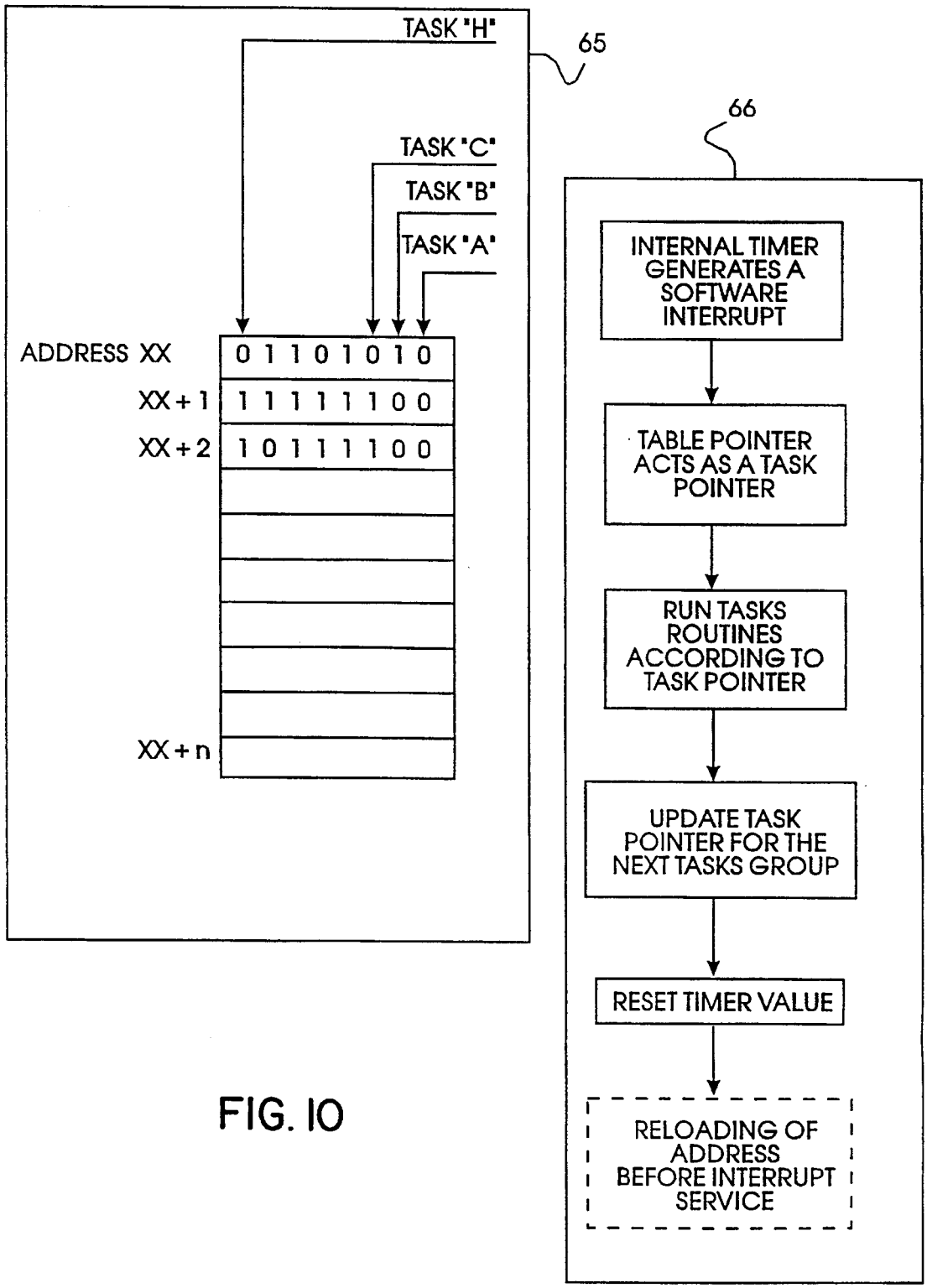
FIG. 10 is a flow diagram for a real time task execution table and real time task execution procedure.

FIG. 10 shows the real time task execution table (65) and the real time task execution procedure (66) present in the FAP, EAP and SAP software for the execution of certain operational routines specific to the structure of the port (keyboard reading, for example), and different from the SSP routines.

Figure 11:
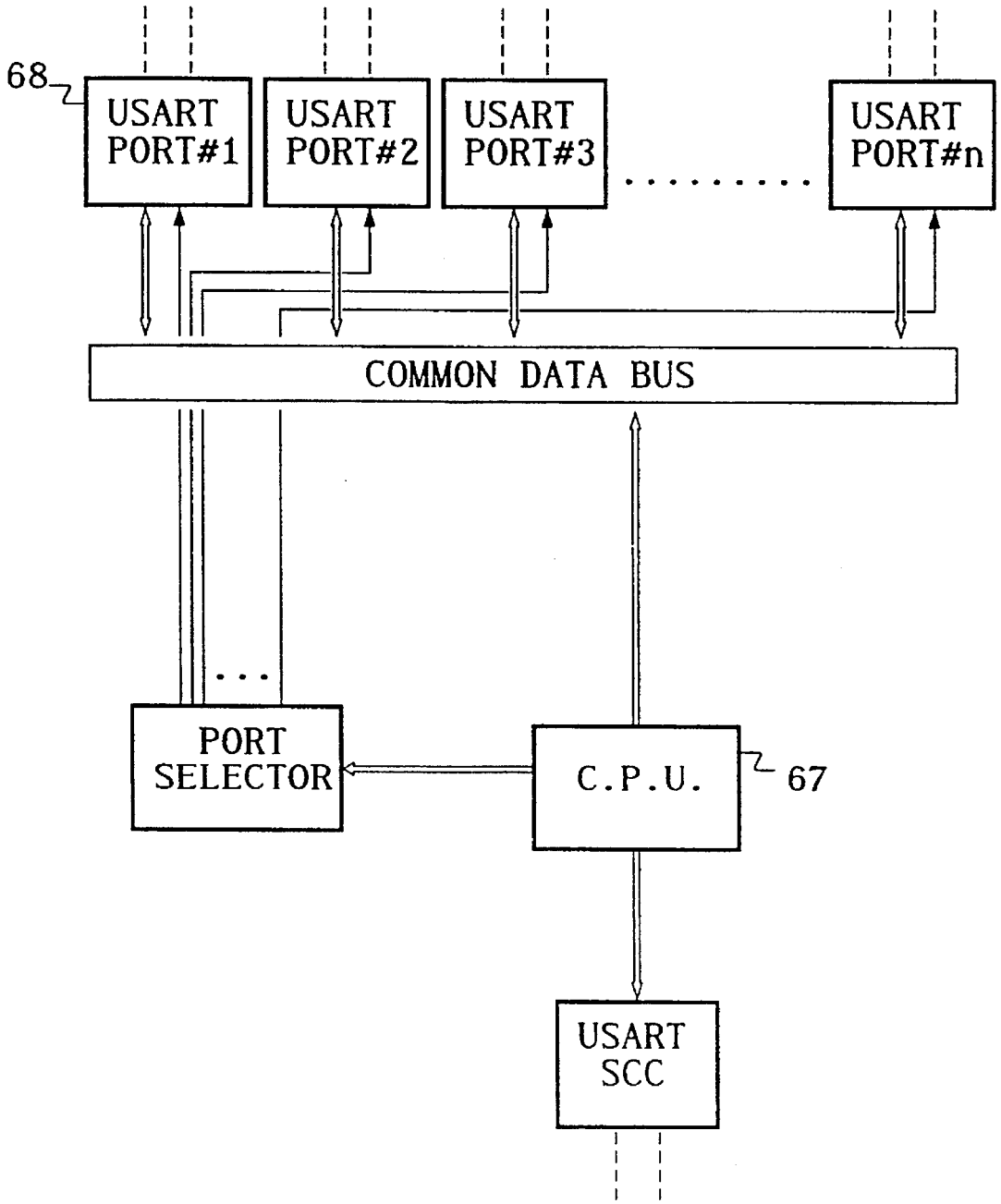
FIG. 11 is a port interface block diagram.

FIG. 11 shows the port interface block diagram where the functional components of the device, such as the CPU (67) and the USART (68), are shown.

Figure 12:
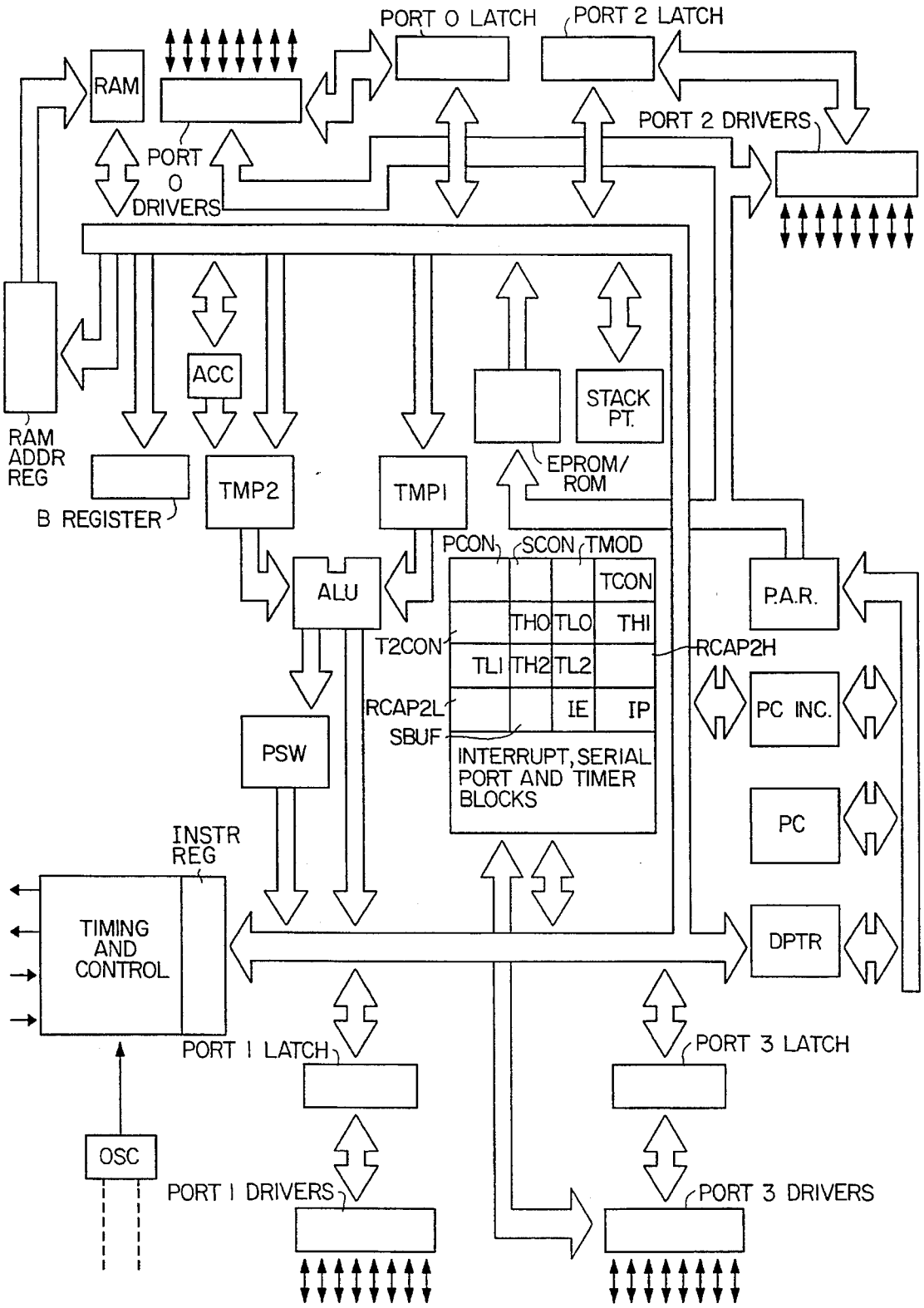
FIG. 12 is a block diagram for the central processing unit.

FIG. 12 shows the architectural block diagram of the microcomputer used in the FAP, EAP, and SAP.

Figure 13:
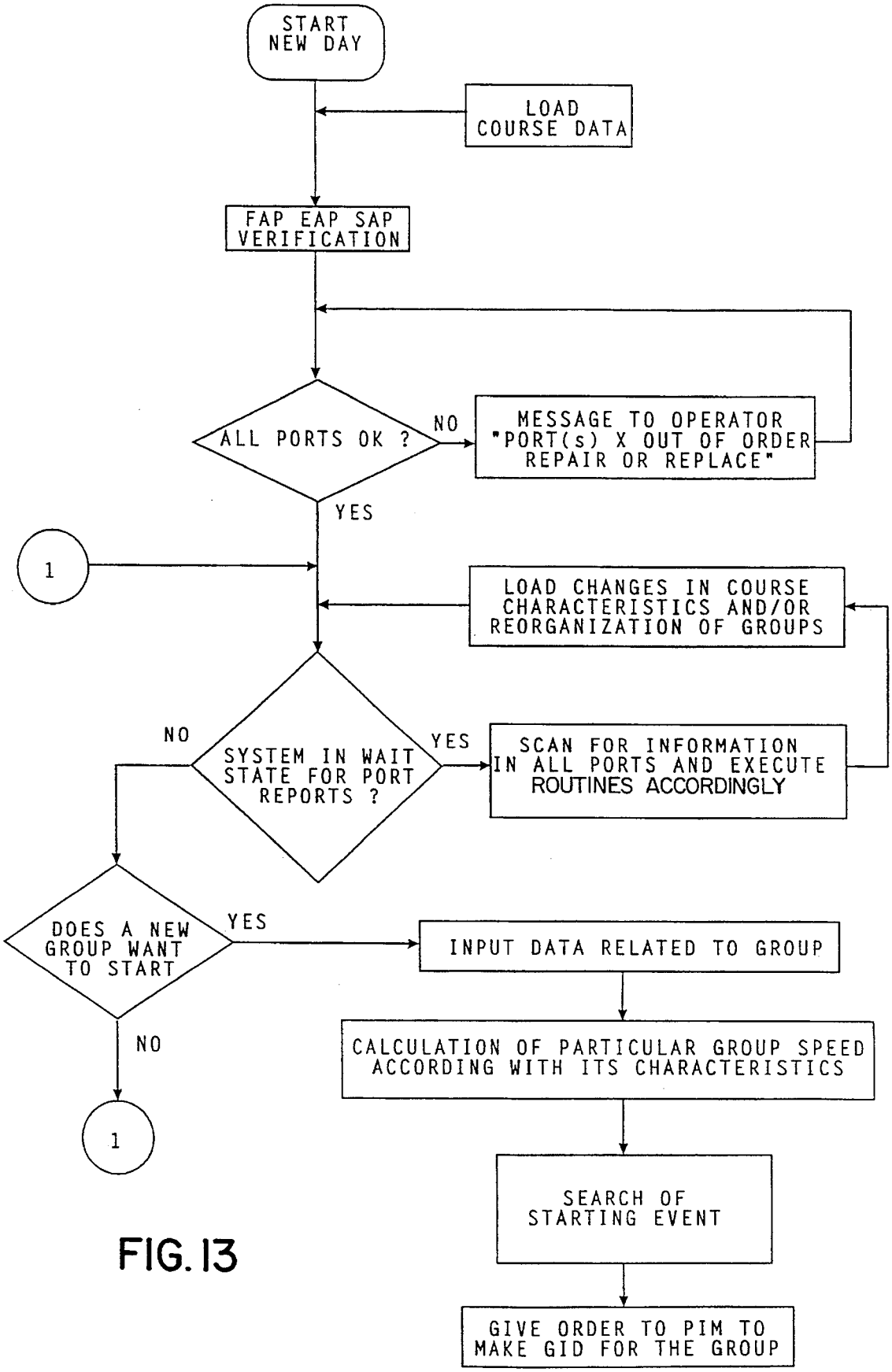
FIG. 13 is a flow diagram for the system software program.
Figure 14:
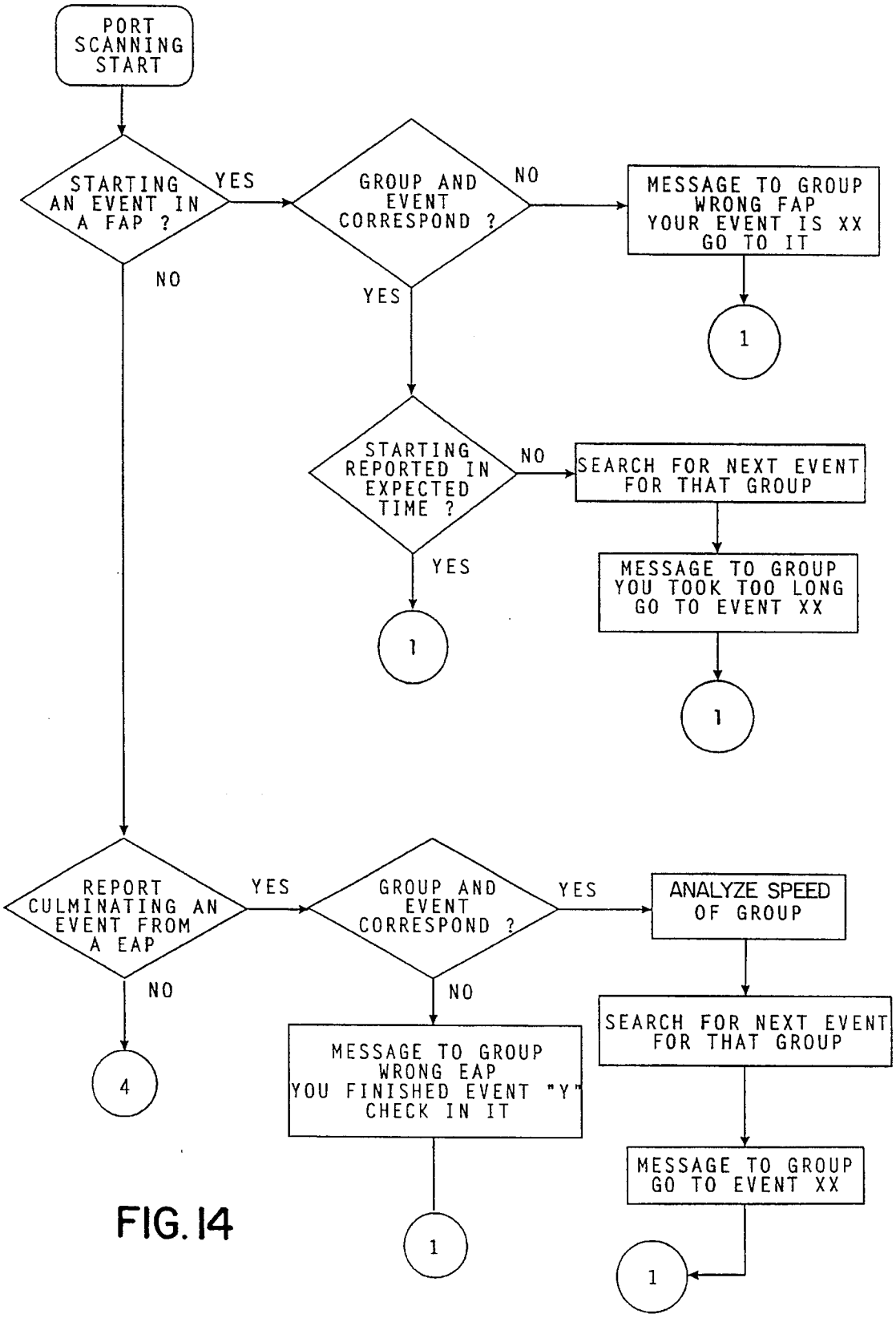
FIG. 14 is a further flow diagram for the system software program, following the flow diagram of FIG. 13.
Figure 15A:
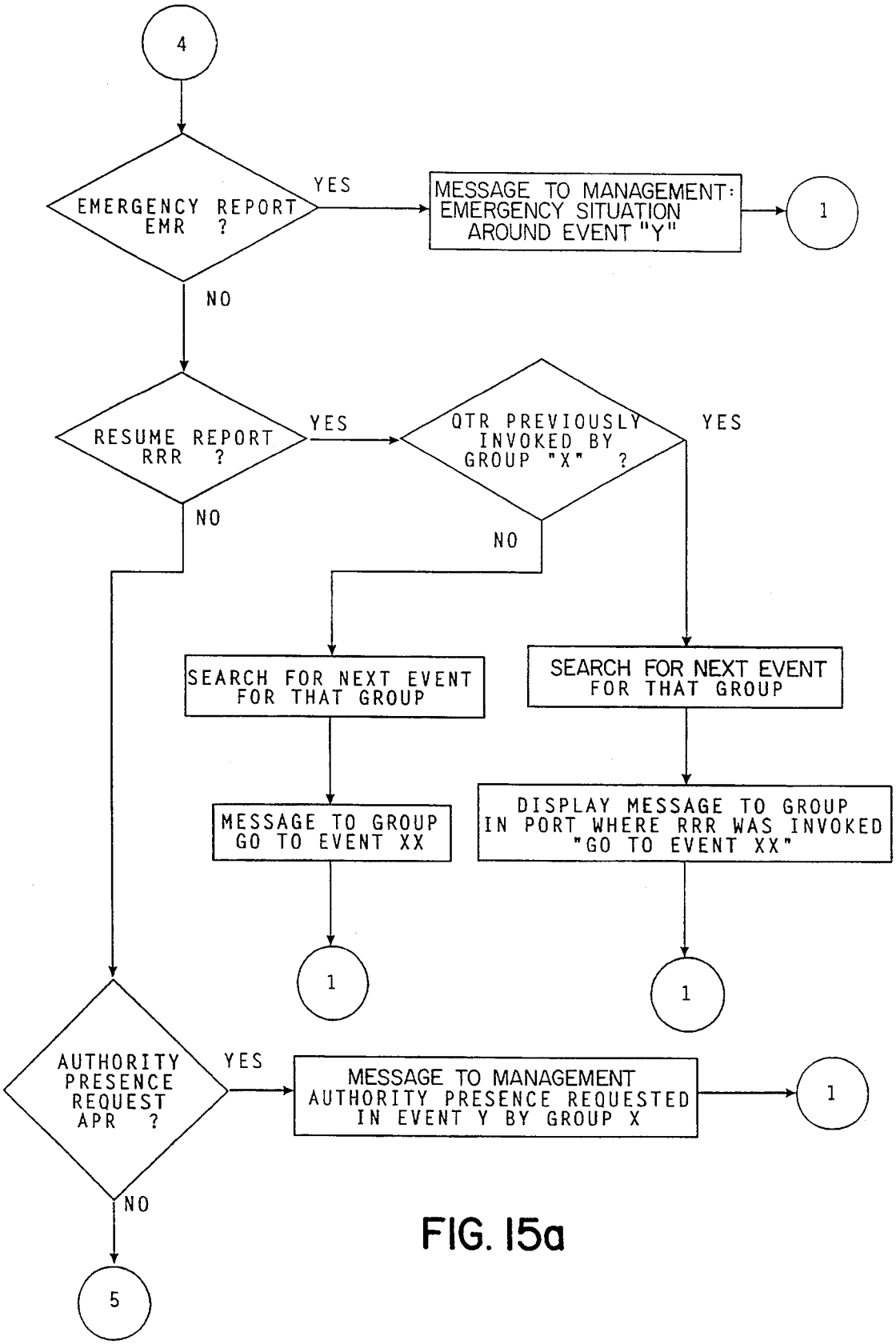
FIG. 15*a* is another flow diagram for the system software program, following the flow diagram of FIG. 14.
Figure 15B:
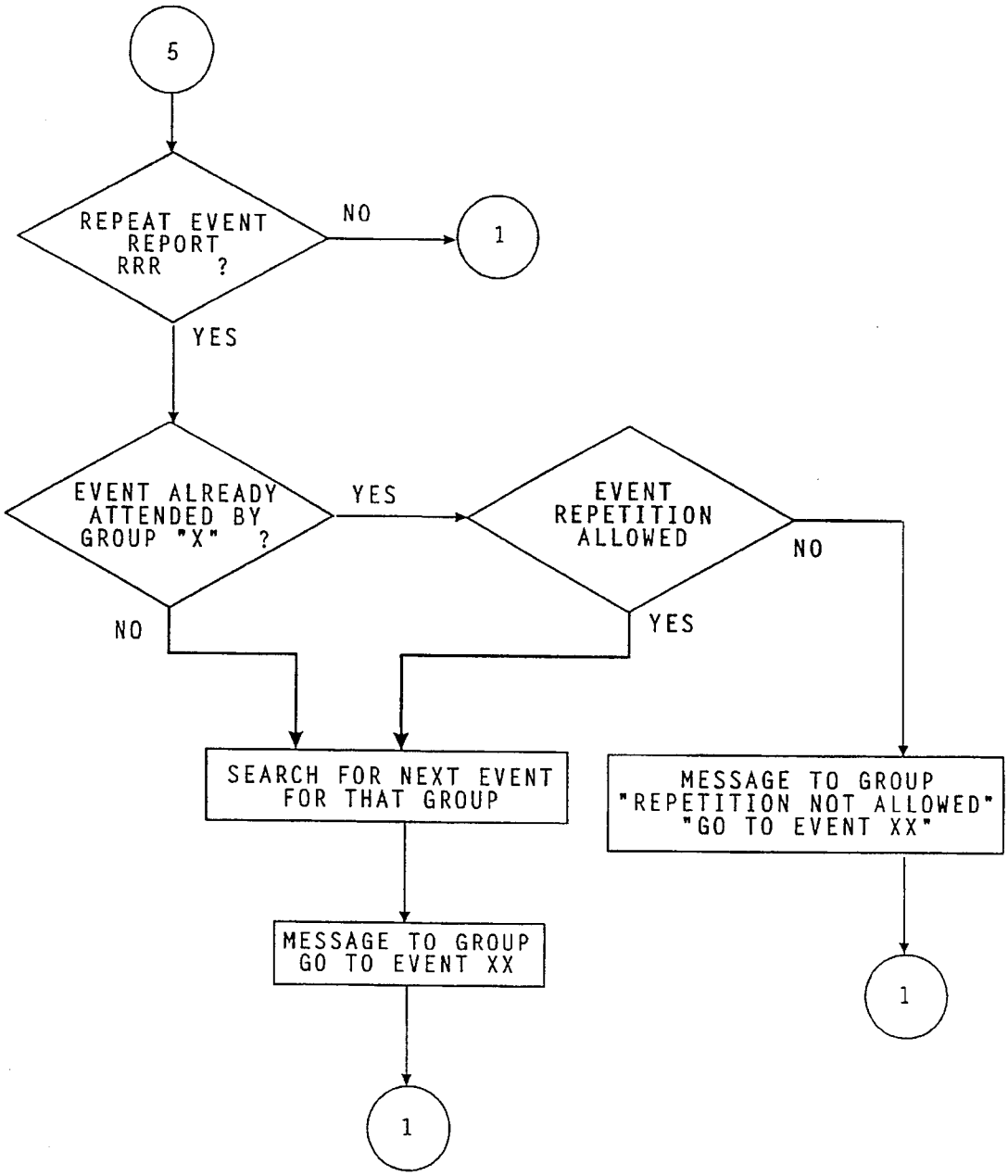
FIG. 15*b* is another flow diagram for the system software program, following the flow diagram of FIG. 15*a*.

FIGS. 13, 14, and 15 consecutively show the System Software Program (SSP) flow diagram, which is self-explanatory.

Figure 16:
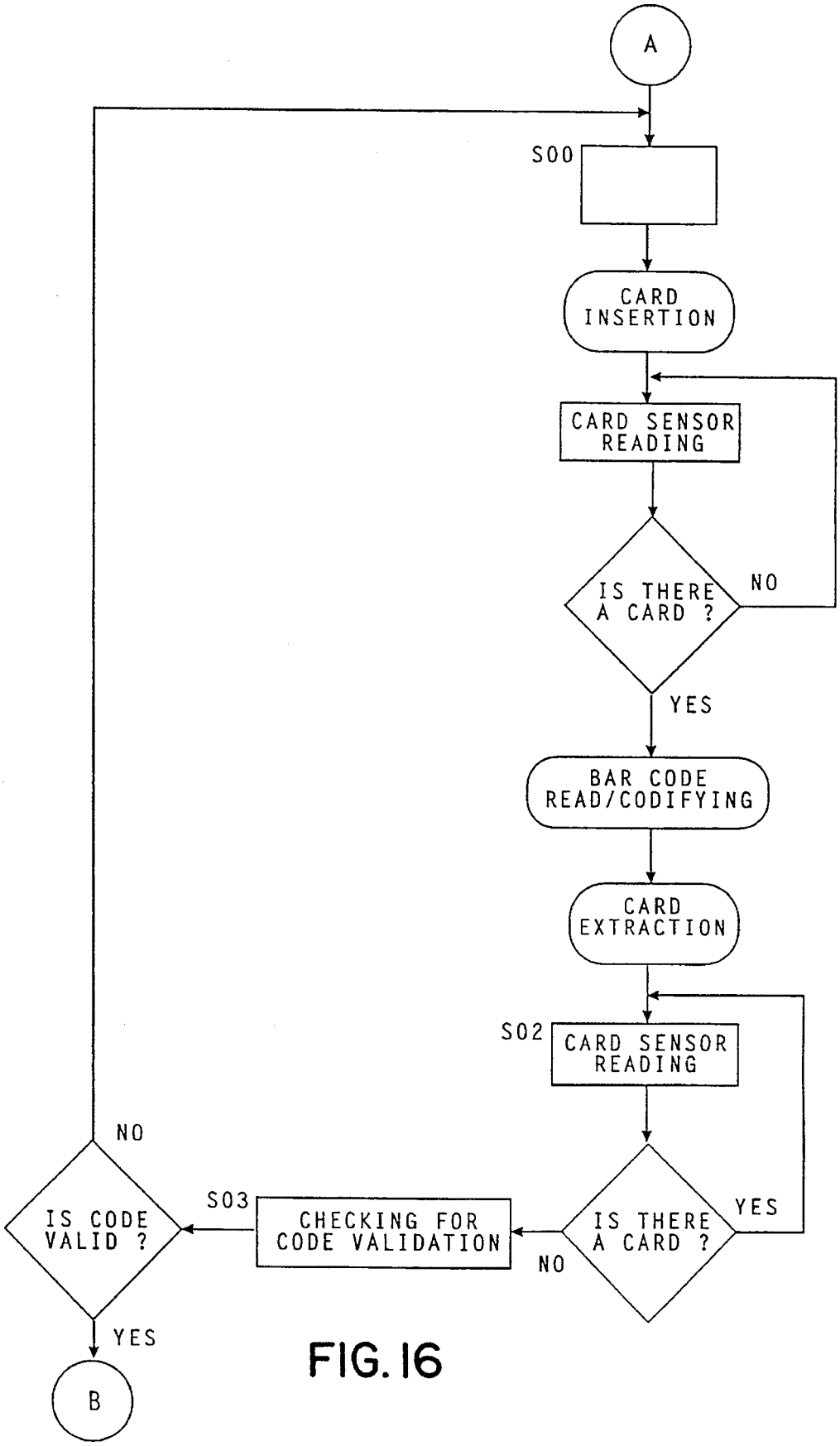
FIG. 16 is a flow diagram showing the algorithmic state machine of the front area port, exit area port and service area port programs.
Figure 17:
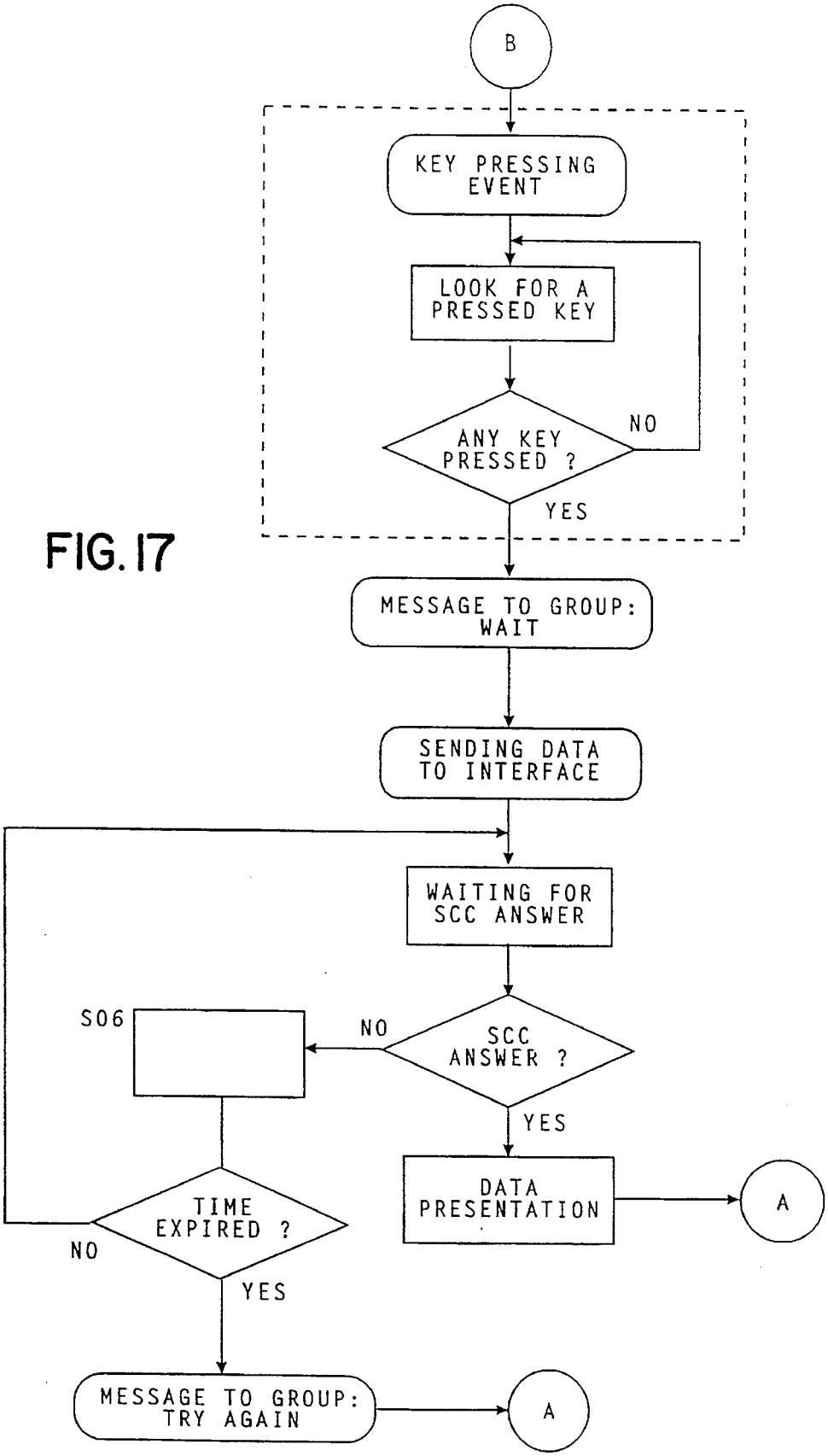
FIG. 17 is a flow diagram showing the algorithmic state machine of the front area port, exit area port and service area port programs, following the flow diagram of FIG. 16.

FIGS. 16 and 17 show the Algorithmic State Machine (ASM) program charts of the FAP, EAP, and SAP, which contemplate the message input alternative featuring the use of the keys by the user (69), but being removable in the algorithm for ports that can be used only by card insertion.

The terms used to describe the system and others terms frequently used are defined below.

MULTIPLE FACILITIES: The term multiple facilities means those facilities, such as museums, educational institutions, fairs, expositions, amusement parks, conventions, sports grounds, and many others, which are for the purpose of offering multiple and simultaneous activities to discrete groups of persons.

MANAGEMENT or ORGANIZATION: The term management or organization means those entities that preside over and dictate the operational and administrative policies of the facilities.

DIFFERENT EVENTS: The term different events means the units of attraction that are offered in a multiple facility, which are circumscribed in physical or virtual places, are independent, and have a beginning or entrance and an end or exit, perfectly defined in a unique position of their own. For example, in an educational type of multiple facility, where the events are courses of different subjects, a single course can be taught in different classrooms every day without being stripped of its own position, which is the material covered in the course. In the same example, the entrance or beginning is the start of the course and its exit or ending is its culmination;the duration of the event is of no importance, and may be weeks, months, or years.

CONSECUTIVE EVENTS: The term consecutive events means the units of attractions, acts, or activities that the installation offers to the users, repetitively and consecutively during the hours of operation of the facility.

CYCLIC EVENTS: The term cyclic events means those events that are presented periodically, in each specific and determined time interval, in a not necessarily consecutive manner.

DISCRETE GROUPS: The term discrete groups means groupings of persons, whose number of members fluctuates between one and the maximum number of persons who can participate in a given event at the same time, and who participate together in the events of the scenario. The groups may be comprised of single persons, groups of friends, family groups, or groups of unrelated people, as in the case of scheduled tourist excursions. Likewise, students who take educational courses together, or executives who attend a convention jointly, constitute discrete groups.

NEXT EVENT: The term next event means the event that a group is ordered by the system to participate in at any given time.

MASS EVENTS: The term mass events means those events that can accommodate large quantities of participants at the same time. Examples of these events are all activities presented in theaters, stadiums, circus tents, and the like, with room for a large number of persons.

SERVICE AREAS: The term service areas means those secondary areas of the multiple facilities that any of the group members may use when necessary or appropriate and where group members generally remain for periods generally shorter than the average duration of the events. In recreational areas, examples of these areas are restaurants, fast-food outlets, bathrooms, information offices, etc. In facilities where the events last months or years, these areas might be places for protracted relaxation, such as resorts, or for medical treatments, such as clinics.

SCENARIO: The term scenario means the physical or virtual space that, under a common management or organization, contains the events. For example, the scenario of an amusement park or a fair is the territorial space in which they are located. In the case of tourist excursions, the scenario virtually delimits the visit sites comprising the excursion. In an educational facility, the scenario comprises the areas where the courses are taught, which may be widely dispersed and remote from one another.

The following considerations concern events in multiple facilities. The events may be active, as in the spectacles of a circus, or passive, as in the exhibition rooms of an art gallery. The groups may engage in active participation, as in an educational installation, golf course or amusement park, or passive participation as spectators of scenes, exhibitions or spectacles.

As dictated by their characteristics and number of components, the groups may or may not modify the duration of events.

The duration of tours, excursions, or educational courses through multiple facilities are quite varied: from fractions of an hour as in small exhibitions, to weeks and even months in tourist trips and educational courses. In some activities, as is the case of educational institutions, the groups may attend different events (academic subjects) at the same time, and have different member configurations, but in all cases, the groups are unique and have their own characteristics until the culmination of the event. After the end of a given event, a reconfiguration of the group members may be necessary, according to the prerequisites in force for attendance.

In the scenarios of multiple facilities, if there is no methodology that takes charge of managing the events and groups in a harmonious fashion, the facilities will fall into underutilization, levels of occupation will be below the maximum possible, and users will be irked and impatient by the delays and inconveniences which are the consequences of such a situation.

In amusement parks, exhibitions, museums, etc., it is common to see long lines of people waiting to attend or participate in a given event, while other events are taking place with a reduced number of patrons or are idle for lack of demand. As a result, many people waste considerable time waiting in lines, which translates into deficient use of the installation, an impediment to achieving the maximum level of its occupation and a nuisance to the users. Another common sight in organizations that offer group transportation between the events of a scenario is that of transportation units going back and forth empty or with a very reduced numbers of passengers during certain periods.

These things take place in multiple facilities for a variety of reasons: because there is a specific sequential order for attending the events which forces the users to adhere to this preestablished order; because the order to follow is left up to the users who, having no overall view of the status of the scenario, make the choice at random without following any necessarily logical criteria; because management does not have adequate knowledge of the groups, events, and scenario at all times; or indeed because the organization does not have the guidance elements permitting it to manage these factors efficiently and harmoniously.

In some types of multiple facilities, some cyclic events are presented at regular intervals (every hour, for example), with no attention paid as to whether sufficient patrons are on hand to justify the presentation. Some multiple facilities routinely present very costly spectaculars in observance of a given schedule or frequency, before an audience too small to justify it from the viewpoint of a cost/benefit ratio.

In its group guidance dynamics, the UIGG system is very careful to look after the interests of the users and the management at the same time, maintaining a harmonious user/operator relationship. The goal of the system is to permit the patrons to enjoy the maximum use of the events offered by the multiple facility, smoothly and without avoidable delay, and to give the management knowledge of the status of its facilities and control thereof so a to achieve and maintain the maximum level of occupation and efficiency at all times.

The UIGG system provides management with a data bank containing detailed information on the activities at a scenario. Such information can cover, in detail, everything happening in the scenario from the time the UIGG system is installed.

The UIGG system gives management a very powerful tool, enabling it to schedule the events and/or group transportation actively and dynamically, as a function of the number of patrons present in the scenario at any time during the hours of operation. For example, in those scenarios composed of cyclic events, the UIGG system, through its knowledge of the characteristics of the groups present, as well as the attractions they have attended and those they have yet to attend, can order the presentation of these events, while at the same time ordering certain groups, the total of whose members reach a given minimum number, to initiate a particular activity. In this manner, cyclic events will be performed before a number of spectators that justifies the cost of presentation of the event.

The UIGG system, by generating a statistical data bank of all the activities of an installation., not only gives management information useful for administrative control, but also permits management to optimize scheduling of events according to recorded experience in the use of the installation.

The UIGG system is conceived for use in any type of facility where each event is independent, separate, and distinguished from each other event or where the activities can be divided up and/or grouped so as to have unique, defined beginnings and endings. The system is conceived in a manner such that it can be used both in small multiple facilities with only a few events, and in large facilities, which may be as large and heavily attended as, for example, "Disneyworld".The UIGG system is also applicable to tourist organizations for which the common scenario is not confined within territorial limits.

While the UIGG system always operates under the same functional principles, the system must be adapted for each installation individually. Both the software and hardware must be tailored to the scenarios, events, and groups that characterize a given installation.

The general components and reports of the UIGG system are described below. The functions of the general components are explained with reference to a specific application.

The UIGG system is a package that basically consists of a program (software) and a series of electronic parts and devices (hardware), which are interconnected and adaptable to any multiple facility. Both the software and hardware can differ in accordance with the requirements of the management and the characteristics of the installation, but they always fulfill the same mission within the UIGG system.

SSP (System Software Program) is a computer program of the expert system type, specifically designed for each installation as a function of its characteristics and management policies.

GID (Group Identification Device) is a device which is codified by mechanical, electromechanical, magnetic or optical means, which contains information concerning a specific group and which is used to communicate with the UIGG system. The GID is analogous to a credit card which provides entry to each event within a scenario or to those events for which it has been programmed.

GIDs can be made in a variety of forms, but are always light weight and easy to carry. In some applications, GIDs might be similar to the tickets currently in use in recreational facilities such as movies, zoos, and amusement parks. Each member of a group might carry a GID or only the group leader might carry a GID, and a GID can be disposable.

In a different UIGG version, the GID is replaced by a "Group Code," known only to the group members but which, for system purposes, continues to be designated as a GID. The GID is referred to as an item or procedure that a group uses to introduce itself to and communicate with the system, whether or not the GID is a physical object.

GIM (Group Identification Maker) is a device or procedure that produces GIDs.

FAP (Front Area Port) is an electronic device located permanently at or near the event entrances, whose function is to read information from the GID, communicate with the system, display messages to the groups on a screen, and send reports from the group to the system by means of keys or buttons provided for such a purpose. In use, a group presents its GID to the FAP at the event starting time to report to the system that the group is beginning to participate in the event.

EAP (Exit Area Port) is a device similar to the FAP, but located at or near the event exits. A group presents its GID to the EAP to report to the system that it has completed the event. The system, in turn, after receiving the report from the group and making an installation analysis, sends information to this EAP about where the group is to go next. The mere insertion and withdrawal of the card without any key stroke may be understood by the system to be completion of participation in the event.

SAP (Service Area Port) is a device similar to the FAP and EAP, installed at strategic locations, generally in service areas, from which the groups can invoke the reports described below.

It is very important to emphasize that the ports, while they always fulfill the same mission within the system, having been conceived for a specific application, may take on different physical forms and operating methods. The ports are not necessarily always equipped with all of the elements mentioned above. In some facilities that offer mass events, for example, some of the system messages to the groups might be conveyed by mass communications media, as will be explained below.

EMR (Emergency Report) is a command present in the FAP, EAP, and SAP which permits the groups, after presenting their GID, to report to the system the appearance of an emergency situation that might alter the normal status of a situation in the installation. Upon receipt of such a report, the UIGG system notifies management to take appropriate action.

QTR (Quit Report) is similar to the EMR. It may be activated, following presentation of the GID, by groups that have decided to discontinue their participation in the events, either temporarily or permanently, prior to completion of all the events for which the GID was programmed. In response to a report of this type, the system records the group's action and holds it in a suspended status.

RRR (Resume Report) is similar to the EMR and QTR and is to be activated by groups, following presentation of their GID, who have decided, after a temporary suspension, to resume their tour. When the system is informed of this circumstance, and knowing which events this group has completed, the group is informed of the event with which it must continue its progress through the scenario.

APR (Authority Presence Requirement) is a command to be activated following presentation of the GID, by groups requiring the presence of an installation authority (management personnel for the scenario) for any reason.

RER (Repeat Event Report) is a system command existing in facilities where repeated participation in a single event is permitted by management, and which groups may invoke when they wish to repeat an event.

SCC (System Control Center) is an electronic equipment group in which the SSP is installed. The SSP processes the data coming from the EAP, FAP, and SAP and then transmits the commands and messages received by the groups through the EAP, FAP, and SAP. The SCC includes the GIM, which is available to it for GID fabrication.

COM (Communication Means) is the means linking the ports, FAP, EAP, SAP and the system control center. The communication may be made by electric or optical cables, or by electromagnetic waves.

The SCC intercommunicates with management for purposes of taking into account event scheduling, maintenance tasks, rendering of services, and dispatching of competent authority to installation sites requiring its presence.

In mass events, the UIGG system may use other methods of communicating with the groups. These may consist of displaying multiple messages for all groups having participated in an event. In such a case, at the end of the events, the system, using a screen large enough to be read by all participants, would indicate, to all of the groups participating in the event, the next event they are to go to. The operation of the system in this variant will be described below.

The use of communication and linking techniques between system elements and between the system and the groups which differ from those described in this application, remain in all cases within the spirit and scope of the Universal Intelligent Group Guidance System.

The operation of the system in a multiple installation is described below. It is assumed that the duration of the events may be modified by the groups, as might be the case in an exhibition of advanced technology products, where the operation and/or application of these products is explained to the groups in various displays, which are the events. The duration of the events might be modified as a function of the number of members in the group or as a function of their knowledge of the subject matter being exhibited.

All of the data for the events in a scenario are fed into the SSP. These event characteristics may be the arrangement of the events in the scenario, the accessibility of each event to other events and to the service areas, the duration, complexity and degree of preference the event enjoys among the patrons, etc.

At the time the members of a group are registered in the installation's ticket office (or its equivalent), the attendant there will ask for their data: name, number of persons, age, degree of skill in the subject of the exhibition, sex of the members, and identification of the group leader, as may be appropriate. If the group wishes to participate in only a given number of events, the leader will tell the attendant which events they are.

The age of the members may be a very important characteristic of the group, but in some facilities, to avoid bothering the members by asking for this information, it may be left to the judgment of the attendant, who will include, along with the other data, whether the group is youthful, adult, senior citizen, or very elderly. This characteristic of the groups, like the sex and skill of the members, may be important to the system, since it may influence the speed that the groups move between and through the events and scenario.

The attendant enters these data into the system and, on the basis thereof, searches for the initial event best suited to the group: an event that determines a logical sequence for the group, with the minimum waiting time. The group is immediately issued its GID, with an indication of the event at which to begin.

This process of collecting the group information and inputting it to the system can be done in many ways, for example: the members dictate the data to the attendant, who enters the same directly into the system control center; the members fill out a form with their information and give it to the attendant, who in turn, inputs it to the SCC; or the members may enter their data in multiple terminals provided for such a purpose.

Upon arrival at the assigned event, the group presents its GID to the FAP, as a signal that they are proceeding to participate in the event. This information is received, stored, and processed by the SCC. When the group has finished participating in the event, the group presents its GID at the EAP, as a signal that it has finished the event. The EAP sends this information to the SCC for processing, and a message is immediately displayed to the group, indicating which event it is to go to next, and at which it must proceed through the routine of presenting its GID at the FAP and EAP. For this purpose, the system conducts an analysis of the scenario in order to send each group to an event or event sequence that is convenient and appropriate for it, in a manner such that no group impedes or is impeded by another group and such that all groups cover the events with the lowest possible number and/or duration of delays.

At any time during the tour, if a group mistakenly presents its GID at an event other than that which was assigned, the FAP of the wrong event will remind the group of the event in which it is designated to participate.

Likewise, if a group presents its GID at a wrong EAP, this pore will so notify it and tell it which event it has just completed, and to which event it must so report.

When a group decides to interrupt its tour temporarily or permanently, without having participated in all the events, whether due to fatigue, bad weather, or some other reason, the group will, after presenting its GID, activate the quit report, reporting its decision to the system. The system, if necessary, will revise the distribution of groups within the installation.

If, as indicated earlier, the group decides to resume its tour, it will present its GID and activate the resume report at any FAP, EAP, or SAP, then await instructions from the system. UIGG is familiar with the group's background and knows what events it has completed and those events to which it must be ordered.

If an emergency that might alter event development should arise in the installation, any of the groups, after presentation of its GID at the nearest FAP, EAP, or SAP, can activate the emergency report. The system immediately notifies management to take the required action.

If a given group decides, following an event, to go to a service area instead of the event to which it has been ordered, it simply goes to the service area, presents its GID at the corresponding SAP, invokes a quit report and later, when it is ready to resume its tour, invokes a resume report, to which the system will respond by informing it of its next event. This exchange of information lets the UIGG system know that the group did not participate in the event to which it had been assigned, and the system carries the information as an event pending for that group, where it will be sent at the most suitable time. At the same time, UIGG makes a note of the service area used by the group, for statistical purposes. To accomplish the same thing, the group may invoke a quit report at the EAP of the event that it has just completed.

If in this facility the management permits groups to participate more than once in the same event, and a group wants to repeat its visit to a particular event, it so notifies the system by invoking a repeat event report, preceded by the presentation of its GID, and followed by identification of the event. Upon receipt of a report of this type, the UIGG system searches for the most suitable time to send the group once more to the event that it wishes to repeat.

If the management permits it in the facility, the UIGG system permits temporary or permanent dissociation of groups. The first of these cases occurs when some of the members of a group attend the event to which it was sent, while their companions remain outside or in a service area. In such a situation, the UIGG system assumes that the group members not participating in the event have no interest in it, but if the group at any time invokes a repeat event report, it will, when suitable, again send the whole group to the cited event.

For purposes of a permanent dissociation of the group, the group members invoke an authority presence requirement, upon which the system requests that a management representative be sent to the group's location. After verifying the configuration of the new groups, this representative reports it to the system. From that time on, the UIGG system deals with the participants as the separate groups that they have become.

In this facility, where the duration of the events may be modified by the groups as a function of their characteristics, the UIGG system maintains surveillance over the speed with which the groups cover each event. In the event a group is not moving along at the rate expected according to its characteristics, the system may warn it of the fact, and even take more severe measures against the group, depending upon management's policy for handling such cases. In certain facilities, such as golf courses, the UIGG system may be very demanding and concerned with all aspects related to event transit times.

Given the universality of the UIGG system, its applications and versions are unlimited, but the principles of operation in multiple facilities are constant. Thus, the only aspects that can vary in the system are the means of intercommunication among the elements comprising it, and between the groups and the system. Nevertheless, and without getting into practical or economic considerations, the system, as described, and without changing any of its components, can be applied in any multiple facility that satisfies the definitions set forth above.

For practical and/or economic reasons, the system may be presented in other versions, such as those briefly described below. All of these versions use components and subsystems that are within the state-of-the art, thus obviating the need to go into great technical detail.

In facilities where groups may not modify the duration of events, or where group characteristics are of no importance in their passage through the scenario, it should be necessary only to know the number of members in a group, and possibly the name of the group leader.

In activities where the groups move through the scenario in some type of vehicle, such as safaris, golf matches, tourist trips, and some excursions, communications among the elements (24) would be by radio. All reports and informational displays could be transmitted by transceivers (19) installed in the vehicles used for these activities. In this version, the golf carts would carry sensors that, on passing through strategic zones in the vicinity of event entrances (21), event exits (22), and service areas (23), would activate and turn on the transceiver for the group leader to indicate the beginning or end of its participation in an event, or to transmit reports such as those described previously. In this case, the transceiver (19) would be equipped with a screen and keyboard similar to those of the FAP, EAP, or SAP. The strategic zones mentioned would have devices to generate magnetic or electromagnetic fields, coded for their full identification. These would be detected and read by the group sensor, which in turn would activate the transceiver to transmit the report applicable to the case, which would be received through the central transceiver antenna (20) of the SCC.

In another version of the UIGG system, the GID is eliminated, being replaced by a "group Code" (39). In this case, the groups identify themselves at the FAP, EAP, and SAP by entering a code on the keys provided for such a purpose at the ports (41).

Presentation of the GID at the FAPs and EAPs can be done automatically through the use of optical or magnetic sensors, which detect the group's presence and activity without the need for manual presentation by the group leader or members. In this version, the manipulation of keys at the ports is necessary only when the groups need to invoke some report other than those of event initiation and completion. In this version, the FAP and EAP ports may be simplified by taking away the keyboard and limiting the reporting capability to the SAP. This measure is practical in those facilities that contain a considerable number of service areas.

In those facilities in which some or all of their events are for mass participation, the system, for practical reasons, may be adapted to operate in a different manner, but always under the same principles of operation, as described below.

In mass events such as large spectaculars, the FAPs would be assigned the sole task of verifying the groups, which, at the event entrance, would present their GIDs at the applicable FAP to report to the system that they are going to participate in the event to which they had previously been sent by the UIGG system. If a given group does not match up with the event, the system will block the entrance and indicate to the group, either with a common screen at the entrance or through the event port, to which event it should be going.

At the conclusion of the show, the system informs all groups as to their next event by means of a screen, which might be inside or outside the event site, depending on its nature. In such a case, the screen, or other mass communication means used, becomes the event EAP, which for practical reasons, would not be equipped with a means for the groups to communicate with the system. The system assumes that if the group entered the event and if, during the event the system received no report from that group, it is because the group has attended the event.

In installations with mass events, the software of the system is essentially the same, and even simpler than that used in some small facilities. However, since the volume of data to be processed in mass installations is of larger proportions, the computer equipment and peripherals must be more powerful and of sufficient speed and capacity to handle the volume of data.

Since the system is able to work in many different technological surroundings, and with many options, the following illustration will describe the components of the system with reference to the Figures.

In this illustration, the presentation from GID to FAP, EAP and SAP, is done manually, GID is a portable bar-code card, and COM is dedicated telephone cables used for each port.

The System Software Program (SSP) is the backbone of the system. It is a program which is able to make decisions and learn from its own experience. SSP is designed to be applied to any type of facility. It is set up with information provided by the management and then it improves itself with its own experience.

The program is designed to designate the most convenient starting event for a group of attendees on a specific facility at a specific time. The program designates a starting event from which a logical sequence can be followed for the continuation of the round of attendance for each group. The program also evaluates the information obtained at each starting event and takes into account many other sources of information, such as the characteristics of the facility, the policies established by the management, the weather and other variables which may arise throughout the day. FIGS. 13, 14 and 15 illustrate schematically the flow of information within the program.

The Group Identification Device (GID) is the key which links each group with the system by means of the FAP, the EAP and the SAP. Its function is that of supplying the most basic information pertinent to the group, such as identification number, time and date of the start, validation code, etc. The GID may be coded in many different ways offered by modern technology, but its function is always the same. The most likely options for storing the information will be magnetic cards or optical systems. The system may alternatively use a 'group code' resembling a group identification number (GC). A GC code could be entered by typing the code on a terminal at each port.

If a card with a magnetic strip is used, the magnetic strip may be offered on a thin plastic card 0.25 mm thick, or less, or it may be offered on a sturdy paper card. The size of the card is approximately the same as a credit card (86×54 mm).

In the example illustrated in FIG. 4(*a*), the information is printed on card 36 in the form of an encoded magnetic strip 37. Other relevant information, such as the date, starting time, and starting event of that group, and the name of the designated group responsible are included in the code. Another GID 36' is illustrated in FIG. 4(*b*) which shows a card having details of the group encoded into a bar code 38. A further GID, 36" shown in FIG. 4(*c*) has the group encoded as a GC or 'group code' 39. Each of the cards shown in FIGS. 4(*a*), 4(*b*) and 4(*c*) also includes information as to the group leader's name 30, starting date and time 31, starting event 32.

The Group Identification Maker (GIM) is a high speed, high definition printer which may be used to print the blank GID cards. Any appropriate printer may be used, such as a dot-matrix, laser, inkjet or thermal printer. The printer preferably has a minimal resolution of 300 dots per inch. A GIM should also be able to print on thin plastic surfaces with similar output to a label printer.

If a 'group code' system is selected, the information may be written manually, without need for a printer.

A Front Area Port (FAP) is an electronic device permanently located near every event entrance area. The device is used by the attendees to inform the system that they are starting to attend that particular event. The FAP also serves to send reports to or receive messages from the system. FIG. 5 shows a typical FAP keyboard on which an attendee may send an Emergency Report (EMR) 43, a Quit Report (QTR) 44, a Resume Report (RRR) 45, an Authority Presence Requirement (APR), a Repeat Event Report (RER) 46 or other report or request.

The communication system developed between the interface-SCC and the interface ports depends on the communication system chosen, which in this case is a "shielded, twisted pair" of telephone cables. Considering that the interface, shown in FIG. 11, is the link of information between the ports and the SCC, one of its objectives is that of organizing and transmitting data. The link between the ports and the interface is capable of storing and sending information, thereby resulting in an efficient communications system. At this point, the interface needs only enough intelligence to handle the transfer of information, there is little or no processing of data.

A typical Front Area APort (FAP) is shown in FIG. 7. The FAP 54 includes an optical reader 40 of the fixed scanner type for use with a GID of the magnetic strip or bar code type, a keyboard 41 for interaction by the attendees with the system, including for entering a GC when a 'group code' GID is used; a small, backlit LCD screen 42 by which the system may send messages or instructions to the attendees; an optical sensor 55 to verify the insertion of the GID (if a card-type GID is used); a central processing unit (CPU) 54; and a bilateral communication processor 56. FIG. 8 shows the architecture of the CPU which provides access to 4 ports 58 of 8 bytes each, all of which are bidirectional, to control the screen,, the keyboard, and the optical sensor. A suitable CPU is made by INTEL (model 8031) of the type MCS-51. This model incorporates the ports directly, simplifying the architecture implemented in the unit. The programmable full duplex serial channel allows for direct control of the communications system.

The architecture of the system, shown in FIG. 8, includes an EPROM memory 61 which includes the monitor program of the FAP; an RAM external memory 59, which is in addition to the internal RAM microprocessor which stores temporary data; a programmable Peripheral Port Interface (PPI) which provides three separate input/output ports which are in addition to those on the PCU (INTEL 8031); and an Address Latch 62 which is used to obtain the directional information in the internal "bus" data and address of the microcontroller. The ALE signal provides the synchronization for the determination of the presence of directional bits.

The architecture shown in FIG. 8 has access to four bilateral ports 58, located on the devices previously mentioned (FAP, EAP, SAP). This assures the flexibility of future setups, even allowing for keyboard expansions.

The software of the FAP, EAP and SAP complies with a structure that allows for future modifications or even the addition of new functions with very few changes. New functions may be added to the system to customize each port according to the functions desired without altering previously existing structures.

FIG. 9 shows the State Machine Functional Scheme utilized to execute the software of the EAP, FAP and SAP which serves the States Table 64 according to the occurrence of predetermined events.

FIG. 10 shows the Real Time Task Execution Table 65, and the Real Time Task Execution Procedure 66 present in the FAP, EAP and SAP software to execute certain functional routines of the Port; these routines differ from those of the SSP.

With respect to the hardware and software that interfaces with each port FAP, EAP, SAP/SCC, as shown in FIG. 11, the interface is fast enough to be able to efficiently handle the maximum number of ports that are established. The structure is similar to the structure of the port shown in FIG. 8. Universal Synchronous Asynchronous Receiver Transmitter devices (USART) 68 are used for transmitting and receiving messages from each port; the interface processor 67 has the task of picking up and placing messages in the ports. The structure of the software monitor of the port interface GID, EAP, SAP/SCC is similar. Only the action commands and the task performed are different.

The FAP, EAP, and SAP are durable and can withstand inclement weather and daily wear by the user. The ports may be hermetically sealed for protection from water and dust.

The screen of a port, as shown in FIG. 5, has a Liquid Crystal Display (LCD) 42 which displays alphanumeric characters. It is preferable that the screen by backlit to allow it to be read even under poor light conditions. The keyboard 41 is waterproof, resistant to abuse, and has a flat, plastic surface. It operates using the concept of a matrix.

A bar-code scanner or magnetic reader 40 is located in the port in such a way that allows movement of the GID by inserting the GID into the port in order to read the codified information. The bar-code or magnetic strip on the GID is located in such a way that there is a separation between the edge of the card and the bar code such that it lets the input optical sensor 55 detect the insertion of the card and be ready for reading the bar code.

Internally, the ports have a card with a printed circuit of the control with the circuit equivalent of the shown architecture and another card with the power supply in a linear fashion with surge control protection. The ports have 110 or 220 volt AC inputs and three DC outputs: +5 volts DC, +12 volts DC and −12 volts DC. Total output is 30 watts distributed in the following manner: 16 watts for the 5 volts DC output and 7 watts for each 12 volts DC output.

A Exit Area Port (EAP) is identical to a FAP, but is coded so that the system can recognize it as being a specific EAP located in a specific exit area.

A Service Area Port (SAP) is identical to a FAP, but is coded so that the system can recognize it as being a specific SAP located in a specific area.

The System Control Center (SCC) located in the registration room is a computer dedicated for use with the UIGG system. It is located in the management area for use by an employee for organizing the parties attending the facility. The SCC may be a part of a main computer equipped with an interface that communicates with the FAPs, EAPs and SAPs.

An SCC should preferably have the following capabilities: a computer with an 80386 or 80486 or higher microprocessor, 33 or 50 MHz or faster speed and 4 to 8 MB RAM memory. Single or double floppy disk drives should be provided, with cache RAM, a 32 bit EISA SCSI controller, two parallel and two serial ports and a Super VGA graphics card with 1 MB RAM.

For inputting data and sending messages, a keyboard of 101 or 124 keys is preferred. The keyboard is also necessary for generating reports and statistics and for entering general data and commands inherent in the system. A color monitor of about 16" is preferable for observing group data and viewing developments on the facility as they occur. A hard disk drive of at least 100 MB is needed to accommodate the structure of the program and to store the operational data of the system. Any printer capable of printing reports required by the management is sufficient.

A serial interface via a serial port so that the SCC can communicate with the FAPs, EAPs, and SAPs according to the protocol established by the SCC is also needed. The system further requires Uninterrupted Power Supply (UPS) used for the backup of the system including ports in case of power failure. A voltage regulator is included to prevent damage to the system and loss of programming and data in case of a blackout in the AC power line.

A mouse for computer operations may be included and is recommended. Even though all the commands may be executed from the keyboard, the use of a mouse simplifies use of the system by the operator.

Optionally, a tape drive with on-line backup capability, or an additional hard disk drive for the mass storage of information may be used. The capacity of the storage is decided by the management.

The Communication Means (COM) is the means of communication and may include two dedicated, shielded telephone cables arranged as one pair of cables per port.

The use of other devices not described herein does not, in any way, diminish the Universal Intelligent Group Guidance System's objectives or fundamentals.

Once the UIGG system's purpose, operation, and possible applications are understood, it becomes evident that the Universal Intelligent Group Guidance System is a universal technique or method, applicable in those activities that comprise the elements of the group, event, and scenario, under a common management or organization, as described and defined in this document.

While the invention has been described with respect to certain embodiments thereof, it will be appreciated by one skilled in the art that variations and modifications may be made without departing from the spirit and scope of the invention.

What is claimed is:

1. A system for guiding a party of people around a facility having a plurality of events to be visited by the party, said system comprising:

a system control center, comprising:

means for receiving and processing information identifying a party, means for receiving and processing information concerning progress of the party through the facility, means for transmitting information concerning each event to and receiving information concerning each event from a front area port and an exit area port, means for determining congestion at each of the events following completion of each event based on information input to the system control center;

means for designating an event to be visited by the party, and means for subsequently designating a next event to be visited by the party based on congestion at the events calculated from information input to the system control center, said next event bearing a calculated designation determined by the system control center;

each said front area port comprising means for transmitting information to and receiving information from the system control center; and each said exit area port comprising means for transmitting information to and receiving information from the system control center;

wherein the events are visited in an order which is determined by the system control center to avoid congestion in response to information identifying the party and information concerning the events received by the system control center from the front area ports-and the exit area ports.

2. A system according to claim 1 further comprising at least one service area port for transmitting information to and receiving information from the system control center.

3. A system according to claim 1 further comprising means for identification of a party for communicating with the system control center, the front area ports and the exit area ports.

4. A system according to claim 3 wherein the means for identification of the party comprises a magnetically encoded card and the front area ports and exit area ports each comprise a magnetic reader.

5. A system according to claim 3 wherein the means for identification of the party comprises a bar coded card and the front area ports and exit area ports each comprise an optical reader.

6. A system according to claim 3 wherein the means for identification of the party comprises a code including a plurality of alphanumeric symbols and the front area ports and exit area ports each comprise means for transmitting said code to said system control center.

7. A system according to claim 1 wherein each port comprises electronic means for recognizing the information identifying the of a party.

8. A system according to claim 7 wherein each port further comprises means for a party identified in the system to communicate with the system service center.

9. A system according to claim 8 wherein the communication means comprises a keyboard.

10. A system according to claim 1 wherein transmission and reception of information is carried out by telephone cable.

11. A system according to claim 1 wherein transmission and reception of information is carried out by fiber optic cable.

12. A system according to claim 1 wherein transmission and reception of information is carried out by radio waves.

13. A system according to claim 1 wherein transmission and reception of information is carried out by AC power line.

14. A system according to claim 12 wherein each party carries a transceiver which is triggered when within a magnetic field or an electromagnetic field of a front area, exit area or service area, whereby the magnetic field or electromagnetic field together with the transceiver comprises the front area port, exit area port or service area port, respectively.

15. A method for guiding a party of people around a facility having a plurality of events, each event having means for communicating with a system control center at a front area port and at an exit area port associated therewith, said method comprising:

(a) entering data identifying the party and data concerning the events into a system control center;

(b) analyzing the entered data with respect to congestion at the events in the facility;

(c) transmitting data between the system control center and the front area ports and exit area ports concerning a designated event to be visited by the party;

(d) monitoring progress of the party at an event according to information identifying the party entered into the system at the ports and transmitted to the system control center;

(e) after each event determining .Congestion at each of the events from information concerning congestion inputted into the System control center;

(f) designating a next event to be visited by the party based on congestion at the events calculated from information inputted to the system control center, following visitation to the event designated in step (c), said next event bearing a designation which alleviates congestion in the facility; and (g) repeating steps (b) through (f) until a selected number of events as registered by the system control center have been visited.

16. A method according to claim 15 further comprising providing at least one service area port in communication with the service control center and inputting information to service area ports for receiving by the system control center.

17. A method according to claim 15 wherein the system control center recognizes the information identifying the a party using a port.

18. A method according to claim 17 wherein the identification of a party is encoded in a magnetically encoded card and the method comprises reading the magnetically encoded card at front area ports and exit area ports each comprising a magnetic reader.

19. A method according to claim 17 wherein the identification of a party is encoded in a bar coded card and the method comprises reading the bar coded card at the front area ports and exit area ports each comprising an optical reader.

20. A method according to claim 17 wherein the information identifying a party is encoded in the system control center as a plurality of alphanumeric symbols and the method comprises transmitting the code from the system control center to front area ports and exit area ports.

21. A method according to claim 17 wherein recognition of the party information comprises a code and the method further comprises transmitting the code from a port to the system control center.

22. A method according to claim 17 further comprising communicating electronically from a port to the system service center.

23. A method according to claim 22 comprising communicating by using a keyboard of a port.

24. A method according to claim 16 wherein the ports are carried by a party in the form of transceivers, the method comprising triggering the transceivers when within a magnetic field or an electromagnetic field of a front area, exit area or service area.

25. A method according to claim 15 wherein transmitting and receiving information is carried out via telephone cable.

26. A method according to claim 15 wherein transmitting and receiving information is carried out by fiber optic cable.

27. A method according to claim 15 wherein transmitting and receiving information is carried out by radio waves.

28. A method according to claim 15 wherein transmitting and receiving information is carried out by AC power line.

* * * * *